US010323824B1

(12) United States Patent
Lim et al.

(10) Patent No.: US 10,323,824 B1
(45) Date of Patent: Jun. 18, 2019

(54) LED LIGHT FIXTURE WITH LIGHT SHAPING FEATURES

(71) Applicant: Cree, Inc., Durham, NC (US)

(72) Inventors: Jin Hong Lim, Morrisville, NC (US); Mark Boomgaarden, Cary, NC (US); Randall Levy Bernard, Cary, NC (US); Eric Marsh, Raleigh, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 15/846,255

(22) Filed: Dec. 19, 2017

(51) Int. Cl.

| | |
|---|---|
| ***F21K 9/272*** | (2016.01) |
| ***F21V 5/08*** | (2006.01) |
| ***F21K 9/275*** | (2016.01) |
| ***F21V 13/04*** | (2006.01) |
| ***F21V 5/04*** | (2006.01) |
| *F21Y 103/10* | (2016.01) |
| *F21Y 115/10* | (2016.01) |

(52) U.S. Cl.
CPC ..... *F21V 5/08* (2013.01); *F21K 9/275* (2016.08); *F21V 5/045* (2013.01); *F21V 13/04* (2013.01); *F21Y 2103/10* (2016.08); *F21Y 2115/10* (2016.08)

(58) Field of Classification Search
CPC . F21V 5/08; F21V 5/045; F21V 13/04; F21K 9/275; F21Y 2103/10; F21Y 2115/10
USPC ..... 362/223, 224, 294, 127
See application file for complete search history.

(56) References Cited

U.S. PATENT DOCUMENTS

| | | | | |
|---|---|---|---|---|
| 7,559,672 | B1 * | 7/2009 | Parkyn | A47B 97/00 362/127 |
| 8,736,186 | B2 | 5/2014 | Chobot | |
| 8,829,821 | B2 | 9/2014 | Chobot et al. | |
| 8,912,735 | B2 | 12/2014 | Chobot et al. | |
| 8,975,827 | B2 | 3/2015 | Chobot et al. | |
| 9,155,165 | B2 | 10/2015 | Chobot | |
| 9,155,166 | B2 | 10/2015 | Chobot | |
| 9,433,061 | B2 | 5/2016 | Chobot | |
| 9,572,226 | B2 | 2/2017 | Motley et al. | |
| 9,622,321 | B2 | 4/2017 | Creasman et al. | |
| 9,786,639 | B2 | 10/2017 | Bergmann et al. | |
| 9,818,919 | B2 | 11/2017 | Lowes et al. | |
| 2003/0156416 | A1 * | 8/2003 | Stopa | B64D 47/02 362/294 |
| 2013/0201675 | A1 * | 8/2013 | Linehan | A47F 11/10 362/224 |
| 2014/0268790 | A1 | 9/2014 | Chobot et al. | |

OTHER PUBLICATIONS

U.S. Appl. No. 61/932,058, filed Jan. 27, 2014.
U.S. Appl. No. 62/292,528, filed Feb. 8, 2016.

* cited by examiner

*Primary Examiner* — Karl D Frech
(74) *Attorney, Agent, or Firm* — Myers Bigel, P.A.

(57) ABSTRACT

A light fixture has a linear LED array and a lens having a first surface and a second surface that covers the LED array. The light being received at the first surface and emitted from the second surface. The lens includes a plurality of light shaping features on at least one of the first surface and the second surface where the plurality of light shaping features are configured to generate a directional light distribution pattern. The light pattern may be symmetric or asymmetric relative to a longitudinal axis of the light fixture. The lens may comprise a plurality of sections where the plurality of sections made of material having different optical properties.

25 Claims, 27 Drawing Sheets

LED LIGHT FIXTURE WITH LIGHT SHAPING FEATURES

BACKGROUND OF THE INVENTION

The invention relates to lighting fixtures and, more particularly, to indirect, direct, and direct/indirect luminaires that are well-suited for use with solid state lighting sources, such as light emitting diodes (LEDs).

Linear ambient light fixtures are ubiquitous in residential, commercial, office and industrial spaces throughout the world. In many instances the legacy linear lighting fixtures include housings that house elongated fluorescent light bulbs that span the length of the housing. The housings may be mounted on, or suspended from, a ceiling or other structures. The housing may also be recessed into the ceiling, with the back side of the housing protruding into the plenum area above the ceiling.

More recently, with the advent of efficient solid state lighting sources, these linear fixtures have been used with LEDs as the light source. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

SUMMARY OF THE INVENTION

In some embodiments a light fixture comprises a LED assembly comprising a linear LED array emitting light when energized through an electrical path. A lens having a first surface and a second surface covers the LED array. The light is received at the first surface and emitted from the second surface. The lens comprises a plurality of light shaping features on at least one of the first surface and the second surface where the plurality of light shaping features are configured to generate a directional light distribution pattern.

The light pattern may be symmetric about a longitudinal axis of the light fixture. The light pattern may be asymmetric relative to a longitudinal axis of the light fixture. The lens may be made of clear acrylic. The first surface may be formed as a plurality of prismatic features. The second surface may be smooth. The second surface may be provided with a diffusive layer. The lens may be semi-circular or rectangular. One half of the first surface may be formed as a Fresnel prism comprising a plurality of first prismatic features and one half of the second surface may be formed as a Fresnel prism comprising a plurality of second prismatic features. A first diffusive layer may be on the first surface opposite the first prismatic features and a second diffusive layer may be formed on the second surface opposite the second prismatic features. A first portion of the first surface may be formed as a Fresnel prism comprising a plurality of first prismatic features and a second portion of the first surface may be smooth and a first portion of the second surface may be formed as a Fresnel prism comprising a plurality of second prismatic features and a second portion of the second surface may be smooth. A first diffusive layer may be on the second portion of the first surface and a second diffusive layer may be on the second portion of the second surface. The light shaping features may be formed on the entire surface of one of the first surface and the second surface. One half of the first surface may be formed as a Fresnel prism comprising a plurality of first prismatic features and one half of the second surface may be formed as a Fresnel prism comprising a plurality of second prismatic features wherein the one half of the first surface may be offset with respect to the one half of the second surface.

In some embodiments a light fixture comprises a housing and a LED assembly comprising a linear LED array supported by the housing. The LED array emits light when energized through an electrical path. A lens having an entry surface and an exit surface covers the LED array for receiving the emitted light at the entry surface and emitting light from the exit surface. The lens comprises a plurality of prismatic elements on at least one of the entry surface and the exit surface. The plurality of prismatic elements are configured to generate a directional light distribution pattern. A diffusive layer is on at least one of the entry surface and the exit surface.

The light pattern may be symmetric about a plane extending perpendicularly to the LED array. The light pattern may be asymmetric relative to a plane extending perpendicularly to the LED array. The lens may comprise a plurality of sections where the plurality of sections made of material having different optical properties. The entry surface may be formed as a Fresnel prism. The lens may comprise a plurality of sections, the plurality of sections may be made of at least two of a clear material, a diffusive material and an opaque material. A reflector may be located inside of the lens. The reflector may be attached to the lens.

DETAILED DESCRIPTION OF EMBODIMENTS OF THE INVENTION

Figure 3:
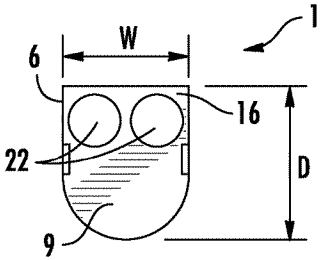
FIG. 3 is an end view of the light fixture of FIG. 1.
Figure 2:
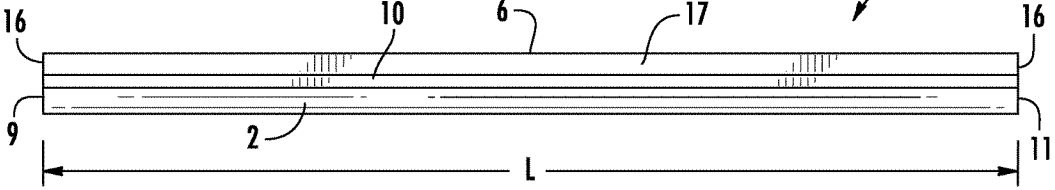
FIG. 2 is a side view of the light fixture of FIG. 1.
Figure 1:
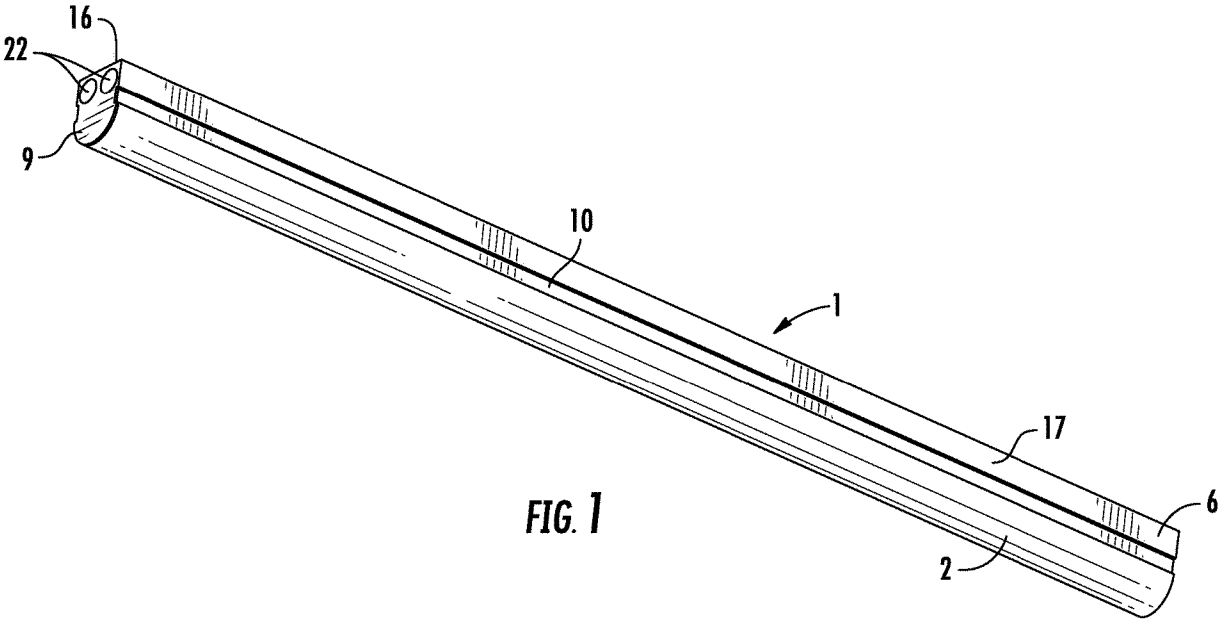
FIG. 1 is a perspective view of an embodiment of a light fixture.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Embodiments of the present invention provide a linear light fixture that is particularly well-suited for use with solid state light sources, such as LEDs. Referring to FIGS. 1 through 5 an embodiment of a light fixture 1 comprises a housing 6 that may be mounted on a surface such as a ceiling, wall or other suitable support structure. The light fixture 1 is shown in the figures in a typical orientation where the light is emitted in a generally downward direction; however, in use the light fixture may assume other orientations. A lens 2 is positioned relative to the housing 6 to create an interior space 4. The interior space 4 created by the lens 2 and housing 6 contains an LED assembly 8 and in some circumstances additional electronics. End caps 9 and 11 may be disposed at either end of the lens 2 to close the interior space 4. In the illustrated embodiment the end caps 9, 11 are formed as an integral part of housing 6 although the end caps may be separate members or may be formed as an integral part of the lens 2. The lens 2 may be removably mounted to the housing 6 by any suitable mechanism. The housing 6 may also support lamp electronics 19 such as a driver, power supply, control circuitry for Smart Cast technology or the like.

The housing 6 may comprise a back panel 14, an end panel 16 secured to each end thereof and a pair of side panels 17 extending from the back panel 16 and between the end panels 16. The side panels 17, end panels 16 and back panel 14 form a compartment 24 for receiving and housing the lamp electronics 19. The side panels 17, end panels 16 and back panel 14 may be made of multiple sheet metal components secured together or the panels and/or housing 6 may be made of a single piece of sheet metal formed into the desired shapes. In some embodiments, the panels may be multiple pieces. In some embodiments, the panels may be separately secured to one another using a clinching joint or by welding, screws, tabs and slots or the like.

A LED mounting structure 10 is supported by the housing 6 and supports the LED assembly 8. The LED mounting structure 10 may comprises a rigid support member 10*a* that supports the LED assembly 8. The support structure 10 may comprise a thermally conductive material such that it functions as a heat sink to dissipate heat from the LED assembly 8. Moreover, the support structure 10 may be thermally coupled to or form part of the housing 6 such that heat from the LEDs is conducted to the housing 6 via the support structure 10. In the illustrated embodiment the support member 10*a* comprises an elongated I-beam structure that is closely received between the side panels 17 and the end panels 16 to close the interior of housing 6 and isolate the power supply and other electrical components 19. The support structure 10 may be secured to the housing 6 by any suitable mechanism such as screws, press fit, clinch joint or the like and may be removably mounted to the housing such that the support structure 10 may be removed from the housing 6 to provide access to the interior compartment 24 of the housing 6 and the lamp electronics 19.

The exposed surfaces of the support member 10*a*, side panels 17 and end panels 16 may be made, coated with or covered in a light diffusive material. The diffusive surfaces of the panels may comprise many different materials. The diffusive surfaces create a uniform, soft light source without unpleasant glare, color striping, or hot spots. The exposed surfaces of the housing may comprise a diffuse white reflector, such as a microcellular polyethylene terephthalate (MCPET) material or a DuPont/WhiteOptics material, for example. Other white diffuse reflective materials can also be used. These components may also comprise aluminum, other metals, ceramics or the like with a diffuse white coating.

Figure 7:
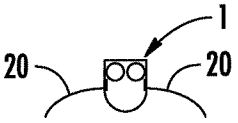
FIG. 7 is an end view of the light fixture of FIG. 6.
Figure 6:
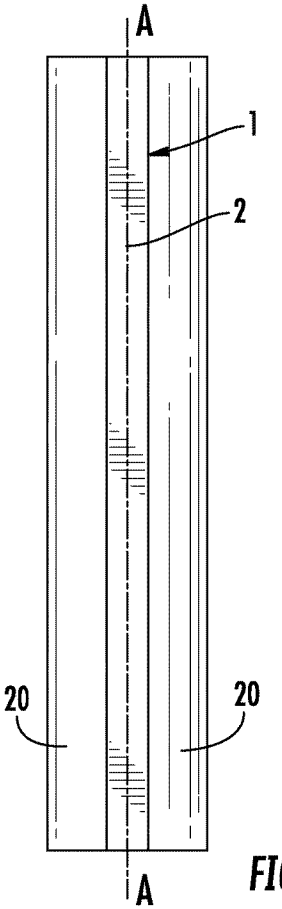
FIG. 6 is a plan view of an alternate embodiment of the light fixture of FIG. 1.
Figure 5:
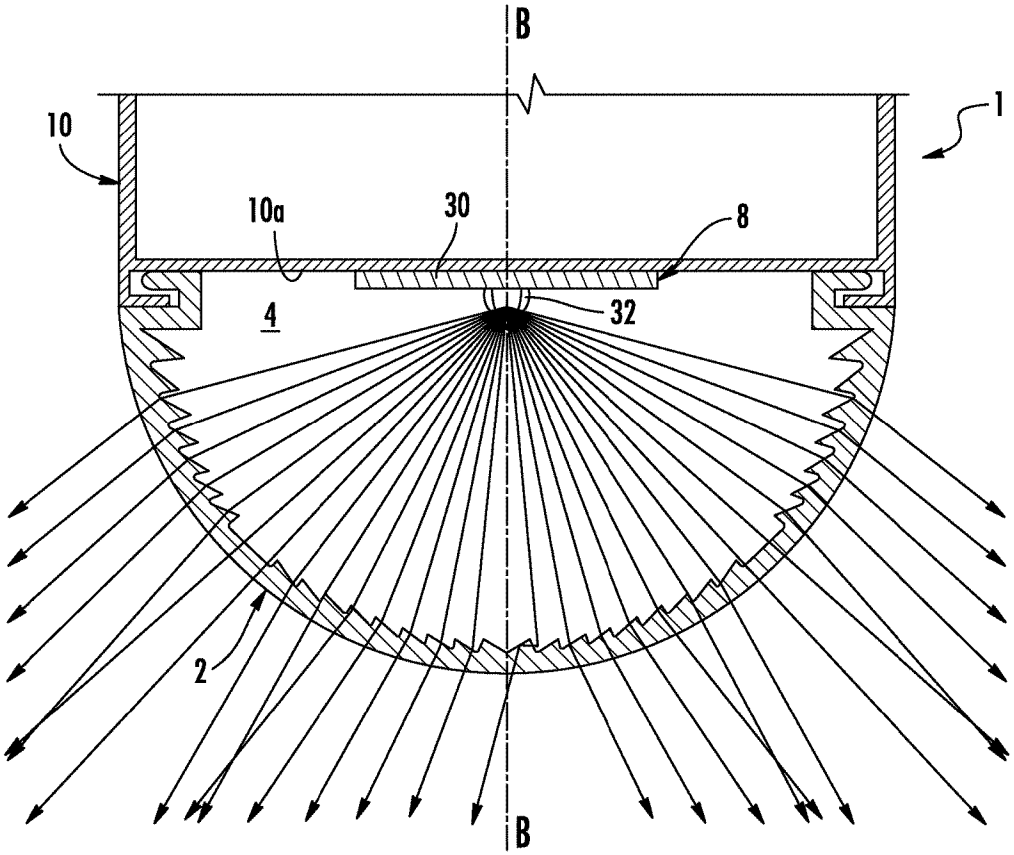
FIG. 5 is a section view of the light fixture of FIG. 1 showing a light emission pattern.

In some embodiments a reflector or reflectors 20 may be positioned to surround the housing 6 to reflect back light toward the front of the light fixture as shown in FIGS. 6 and 7. The exposed surfaces of the reflectors 20 may be white diffusive. For example the reflectors may be made of or covered by white diffusive panels. The diffusive surfaces of the reflectors 20 may comprise many different materials. The diffusive surfaces may comprise a diffuse white reflector, such as a microcellular polyethylene terephthalate (MCPET) material or a DuPont/WhiteOptics material, for example. Other white diffuse reflective materials can also be used. The reflectors may also be aluminum other metals, ceramics or the like with a diffuse white coating. Moreover, the reflectors may be formed as part of the housing 6 rather than as separate panels. The reflectors 20 may be solid or they may include apertures to allow some light to pass through the reflectors.

The light fixture may be provided in many sizes, including standard fixture sizes. In one embodiment the lighting fixture has a width W of approximately 2.5 inches and a depth D of approximately 3.0 inches and may come in a length L such as four feet or eight feet. However, it is to be understood that the light fixture may have different dimensions. For example, the light fixture may have a width between approximately 2 and 24 inches and a depth between approximately 3 and 10 inches although the light fixture may come in any suitable dimensions. Furthermore, it is understood that embodiments of the fixture can be customized to fit most any desired fixture dimension. Moreover, multiple light fixtures may be joined together end to end to create a light fixture assembly of longer lengths. For example electrical connectors may extend through knockout holes 22 to electrically couple multiple light fixtures together. The light fixtures may be mechanically coupled together by separate brackets (not shown). The light fixture 1 may be suspended by cables, or mounted directly on a surface such as a ceiling wall or other support structure. In other embodiments the light fixture 1 may be mounted within a T grid ceiling system. Other mounting systems and mounting mechanisms may also be used.

Figure 4:
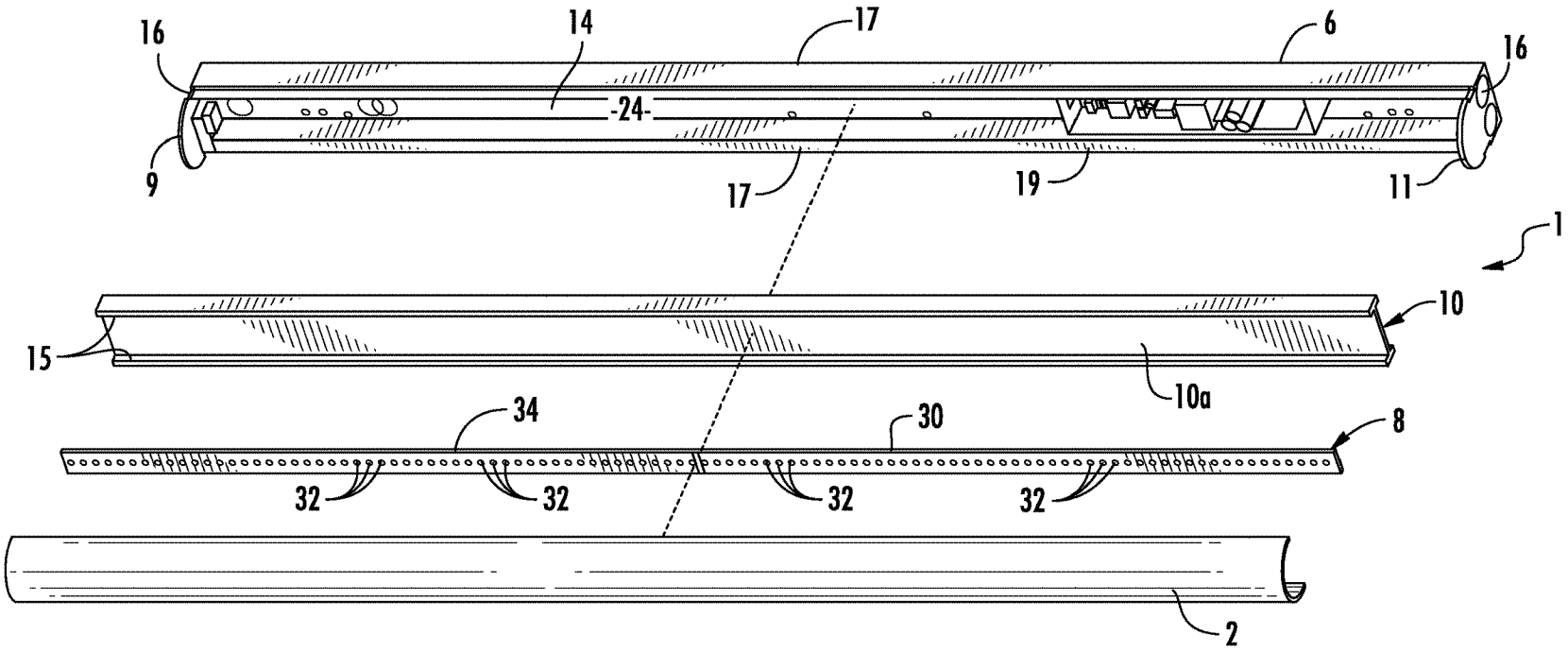
FIG. 4 is an exploded perspective view of the light fixture of FIG. 1.

The lamp electronics 19 may comprise a driver circuit or multiple driver circuits housed within compartment 24. Electronic components within the compartment 19 may be shielded and isolated. Various driver circuits may be used to power the light sources. Suitable circuits are compact enough to fit within the compartment, while still providing the power delivery and control capabilities necessary to drive high-voltage LEDs, for example. At the most basic level a driver circuit may comprise an AC to DC converter, a DC to DC converter, or both. In one embodiment, the driver circuit comprises an AC to DC converter and a DC to DC converter, both of which are located inside the compartment. In another embodiment, the AC to DC conversion is done remotely (i.e., outside the fixture), and the DC to DC conversion is done at the control circuit inside the compartment. In yet another embodiment, only AC to DC conversion is done at the control circuit within the compartment. Some of the electronic circuitry for powering the LEDs such as the driver and power supply and other control circuitry may be contained as part of the LED assembly 8 or the lamp electronics may be supported separately from the LED assembly such as in housing 24 as shown in FIG. 4.

The LED assembly 8 comprises a LED board 30 with light emitters such as LEDs 32 arranged in a linear array. The LED assembly may comprised one, two or more linear LED arrays each comprising a linear row of LEDs. The LED board and LED array may extend for substantially the entire length of the housing 6 to create a linear ambient light fixture. The LED board 30 may be any appropriate board, such as a PCB, flexible circuit board or metal core circuit board with the LEDs 32 mounted and interconnected thereon. The LED board 30 or multiple LED boards may be aligned with the longitudinal axis A-A of the housing 6 and lens 2. It is understood that nearly any length of LED board 30 can be used. In some embodiments, any length of LED board can be built by combining multiple boards 30, 34 together to yield the desired length. The LED board 30 may be connected to the support member 10*a* by any suitable connection mechanism including adhesive, screws, snap-fit connectors, board receptacles or the like. The LED board 30 can include the electronics and interconnections necessary to power the LEDs 32. The LED board 34 provides physical support for the LEDs 22 and may form part of the electrical path to the LEDs for delivering current to the LEDs The term "electrical path" is used to refer to the entire electrical path to the LEDs 32, including an intervening power supply and all the electronics in the lamp disposed between the electrical connection that would otherwise provide power directly to the LEDs. Electrical conductors run between the LEDs and the source of electrical power, such as a buildings electrical grid, to provide critical current to the LEDs 32.

Details of suitable arrangements of the LEDs and lamp electronics for use in the light fixture 1 are disclosed in U.S. patent application Ser. No. 15/226,992, entitled "Solid State Light Fixtures Suitable for High Temperature Operation Having Separate Blue-Shifted-Yellow/Green and Blue-Shifted-Red Emitters" filed on Aug. 3, 2016 which is incorporated by reference herein in its entirety. In other embodiments, all similarly colored LEDs may be used where for example all warm white LEDs or all warm white LEDs may be used where all of the LEDs emit at a similar color point. In such an embodiment all of the LEDs are intended to emit at a similar targeted wavelength; however, in practice there may be some variation in the emitted color of each of the LEDs such that the LEDs may be selected such that light emitted by the LEDs is balanced such that the lamp emits light at the desired color point. In the embodiments disclosed herein a various combinations of LEDs of similar and different colors may be selected to achieve a desired color point. Each LED element or module may be a single white or other color LED chip or other bare component, or each may comprise multiple LEDs either mounted separately or together on a single substrate or package to form a module including, for example, at least one phosphor-coated LED either alone or in combination with at least one color LED, such as a green LED, a yellow LED, a red LED, etc. In those cases where a soft white illumination with improved color rendering is to be produced, each LED element or module or a plurality of such elements or modules may include one or more blue shifted yellow LEDs and one or more red LEDs. The LEDs may be disposed in different configurations and/or layouts as desired. Different color temperatures and appearances could be produced using other LED combinations, as is known in the art. In one embodiment, the light source comprises any LED, for example, an MT-G LED incorporating TrueWhite® LED technology or as disclosed in U.S. patent application Ser. No. 13/649,067, filed Oct. 10, 2012, entitled "LED Package with Multiple Element Light Source and Encapsulant Having Planar Surfaces" by Lowes et al., the disclosure of which is hereby incorporated by reference herein in its entirety, as developed and manufactured by Cree, Inc., the assignee of the present application. In any of the embodiments disclosed herein the LEDs 32 may have a lambertian light distribution, although each may have a directional emission distribution (e.g., a side emitting distribution), as necessary or desirable. More generally, any lambertian, symmetric, wide angle, preferential-sided, or asymmetric beam pattern LED(s) may be used as the light source. Various types of LEDs may be used, including LEDs having primary optics as well as bare LED chips. The LED elements may be disposed in different configurations and/or layouts as desired. Different color temperatures and appearances could be produced using other LED combinations, as is known in the art.

Further, any of the embodiments disclosed herein may include one or more communication components forming a part of the light control circuitry, such as an RF antenna that senses RF energy. The communication components may be included, for example, to allow the luminaire to communicate with other luminaires and/or with an external wireless controller. More generally, the control circuitry includes at least one of a network component, an RF component, a control component, and a sensor. The sensor, such as a knob-shaped sensor, may provide an indication of ambient lighting levels thereto and/or occupancy within the room or illuminated area. The communication components such as a sensor, RF components or the like may be mounted as part of the housing or lens assembly. Such a sensor may be integrated into the light control circuitry. In various embodiments described herein various smart technologies may be incorporated in the lamps as described in the following United States patent applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks," application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No. 13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," Application No. 61/932,058, filed Jan. 27, 2014, which is incorporated by reference herein in its entirety. Additionally, any of the light fixtures described herein can include the smart lighting control technologies disclosed in U.S. Provisional Application Ser. No. 62/292,528, titled "Distributed Lighting Network", filed on Feb. 8, 2016 and assigned to the same assignee as the present application, the entirety of this application being incorporated by reference herein.

Figure 42:
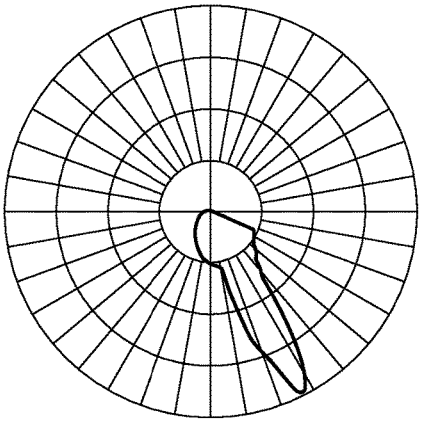
FIGS. 42-45 are intensity distribution diagrams of the lighting fixture useful in explaining the invention.
Figure 43:
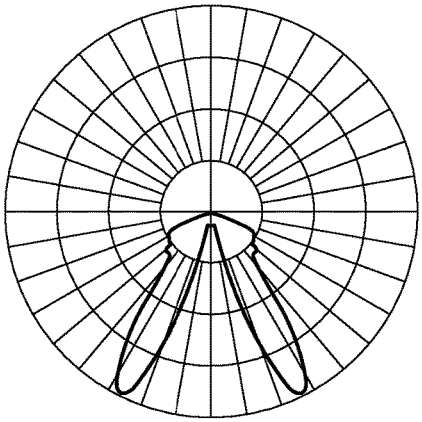
Figure 44:
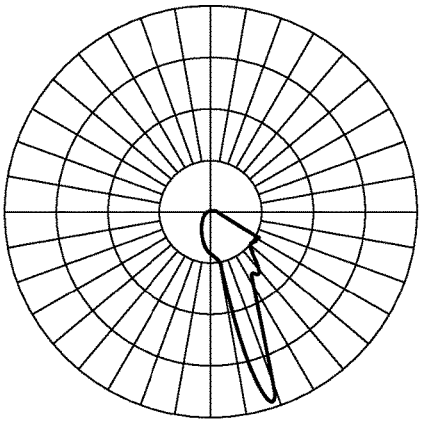
Figure 45:
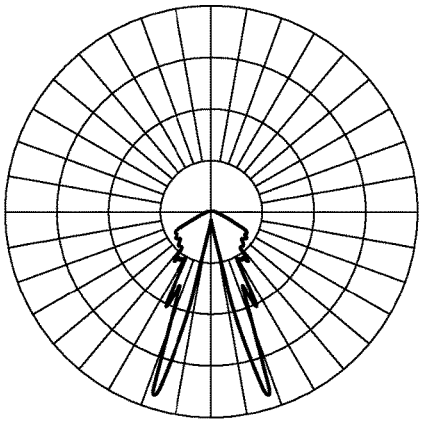

In a linear light fixture as described herein it may desirable to emit light from the lens directionally in a predetermined pattern. The lens of the invention generates a desired light emission pattern using light shaping features such as Fresnel prism features. In one embodiment the emitted light pattern is symmetrical across the longitudinal center plane B-B of the light fixture as is shown in the luminance graphs of FIGS. 17 through 22 where a distinct peak emission is symmetrically emitted along each side of the light fixture to both sides of plane B-B. Such a light emission pattern is sometimes referred to herein as a "V" or batwing light emission pattern. In other embodiments the light may be emitted asymmetrically relative to the plane B-B of the light fixture where light is primarily emitted to one side of the longitudinal center plane B-B of the light fixture as shown in the luminance graphs of FIGS. 32 through 34 sometimes referred to herein as a single wing or wall wash light emission pattern. The batwing emission pattern may be particularly useful to illuminate the racks in an aisle such as a grocery store and the single wing or wall wash may be used to illuminate a wall although the light fixture may be used in any application. The lens of the invention may be used to provide other light emission patterns as will be described. The lighting systems as described herein may provide an illumination pattern where backlight accounts for less than 10% of the total light emitted from the lighting fixture. Backlight is considered the light emitted past 90 degrees. Thus, for example, referring to FIG. 5 the backlight is light emitted upward past the plane of the LEDs as viewed in the figure. The lens of the invention provides low glaring and has an optical efficiency of over 90%. In one embodiment the peak intensity angle is approximately 27 degrees against the vertical plane with a beam spread of 20deg (FWHM). FIG. 42 shows a single wing or wall wash light distribution and FIG. 43 shows a batwing distribution with a peak intensity angle of approximately 27 degrees against the vertical plane and a beam spread of 20deg (FWHM) as generated by a lens configured similar to the lens of FIGS. 26 and 5, respectively. In other embodiments the peak intensity angle is approximately 18 degrees against the vertical plane. FIG. 44 shows a single wing or wall wash light distribution and FIG. 45 shows a batwing distribution with a peak intensity angle of approximately 18 degrees against the vertical plane as generated by a lens configured similar to the lens of FIGS. 26 and 5, respectively. The peak intensity angle and beam spread may be changed using the same type of lens by changing the angles of the features. In some embodiments, the batwing distribution may have different peak angles at each side of the light fixture.

Embodiments of the structure of the lens 2 will now be described. The lenses described herein may be a one-piece member or it may be constructed of multiple pieces assembled to create the lens. In one embodiment the entire lens is entirely light transmissive. The lens may be mounted to the housing 6 by any suitable mechanism and in one embodiment is removably mounted to the housing 6 or support structure 10. The lenses described herein may be made of a transparent material such as clear acrylic but the lens may be made of other materials such as glass, polycarbonate, nylon, cyclic olefin copolymer or ceramic or other optic materials or combinations of such materials.

Figure 10:
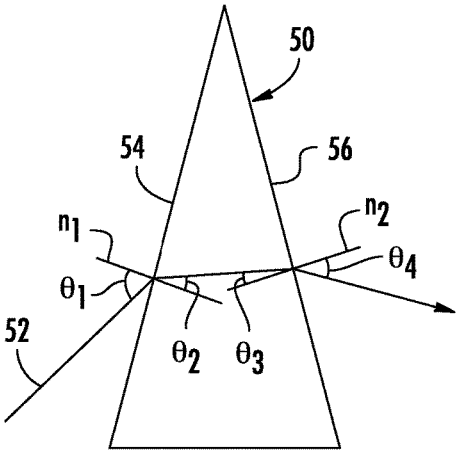
FIGS. 10-13 are schematic views of various embodiments of lenses useful in explaining the invention.
Figure 12:
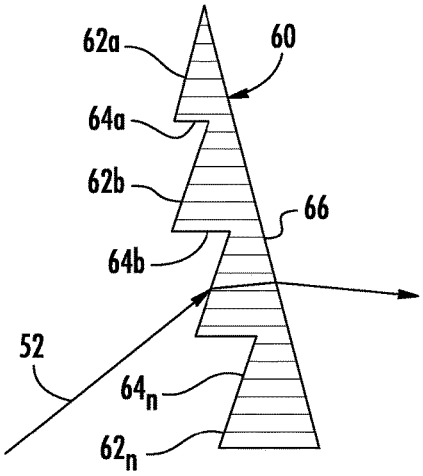
Figure 11:
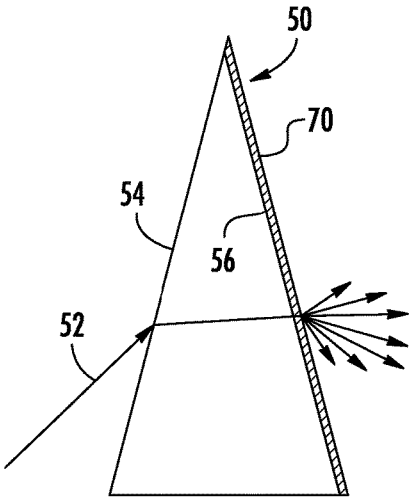

In some embodiments, the lens of the invention may use a Fresnel prism as the light shaping features to refract light entering the lens to direct the light to achieve a desired illumination pattern. Referring to FIGS. 10 and 11 the operation of a prism 50 is briefly explained. A light ray 52 incident on the entry surface 54 at angle θ1 is refracted and travels within the prism 50 at angle θ2. The light ray exits the prism 50 at the exit surface 56 and is refracted at angle θ4. Angles θ1 & θ2 are the incident and refracted angle, respectively, against normal line $n_1$, normal to entry surface 54 and angles θ3 & θ4 are the incident and refracted angle, respectively, against normal line $n_2$, normal to exit surface 56. All of the light rays entering and exiting the prism 50 with an incident angle that is not perpendicular to the surface change their directions according to Snell's law. By varying the angles of the entry and exit surfaces relative to the light rays the direction of the emitted light may be controlled. FIG. 12 shows a Fresnel prism 60. A Fresnel prism 60 is composed of several small pieces of prisms or prismatic features 62*a*, 62*b* . . . 62*n*, formed by grooves 64*a*, 64*b* . . . 64*n*, where the individual prismatic features may have the identical facet angle to the original prism angle of FIG. 10. A Fresnel prism such as shown in FIG. 12 gives the same optical refraction properties as the regular prism such as shown in FIG. 10; however, the small prismatic features 62*a*, 62*b* . . . 62*n* enable the volume of the prism to be reduced and make it feasible to make a thin prism. The exit directions of the light can be changed within a target range by varying the individual prism angles of the prismatic features relative to the incident light rays and by changing the number or frequency of the prismatic features. In some embodiments the entry surface to the Fresnel features may be curved rather than straight to further mix the light and soften the light emitted from the lens. While the light shaping feature as used herein may in some embodiments be a Fresnel prism, the light shaping feature may include any optic such as lenses that shapes the light in a controlled manner that can be used to create a directional light emission pattern.

Figure 13:
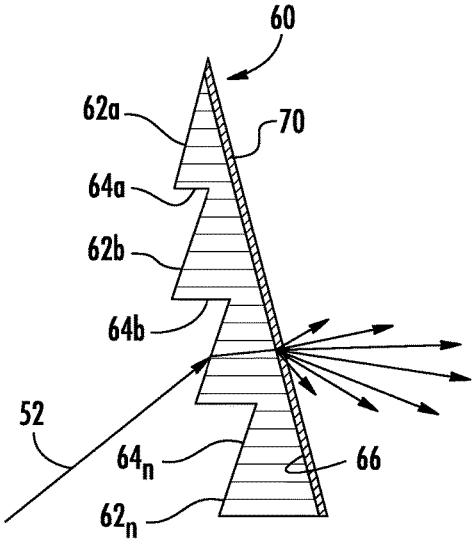

Referring to FIGS. 11 and 13 adding a surface diffuser or texture feature 70 on the exit surface 56 of the prism or the exit surface 66 of the Fresnel prism allows the outgoing light to be dispersed, but the peak angle is maintained such that light is emitted in a direction along the same line as with the prism without the diffuser. This surface diffuser or texture feature 70 reduces hot spots or glaring and makes the light soft with a broader intensity distribution. Depending on the diffusing angle of the diffuser, the main peak beam can be maintained while providing some wide distribution. The surface diffuser or texture feature 70 on the exit surface enables the refracted outgoing rays to disperse with a wide angular distribution. However, the main light angle is maintained.

Figure 8:
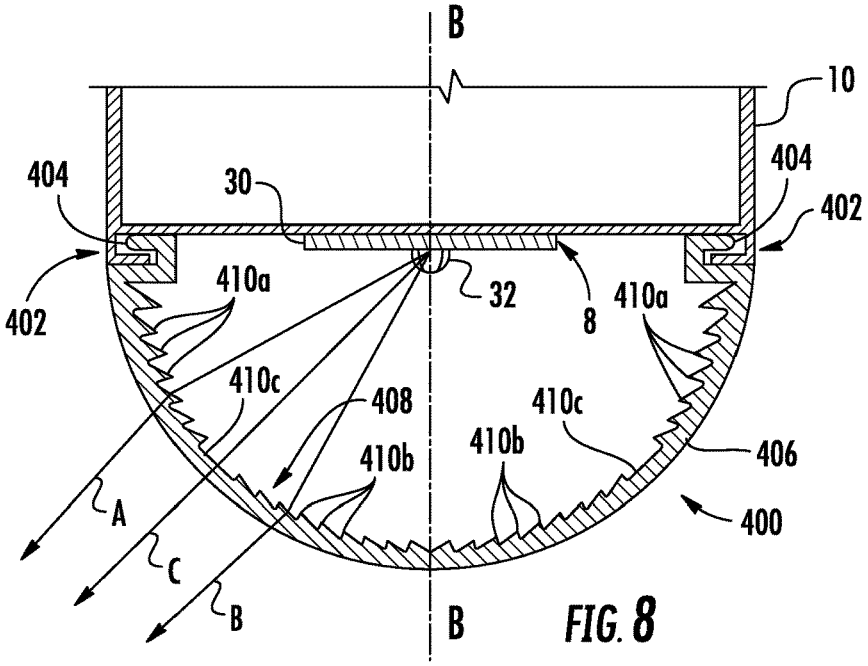
FIGS. 8 and 9 are section views of embodiments of lenses usable in the light fixture of FIG. 1.
Figure 9:
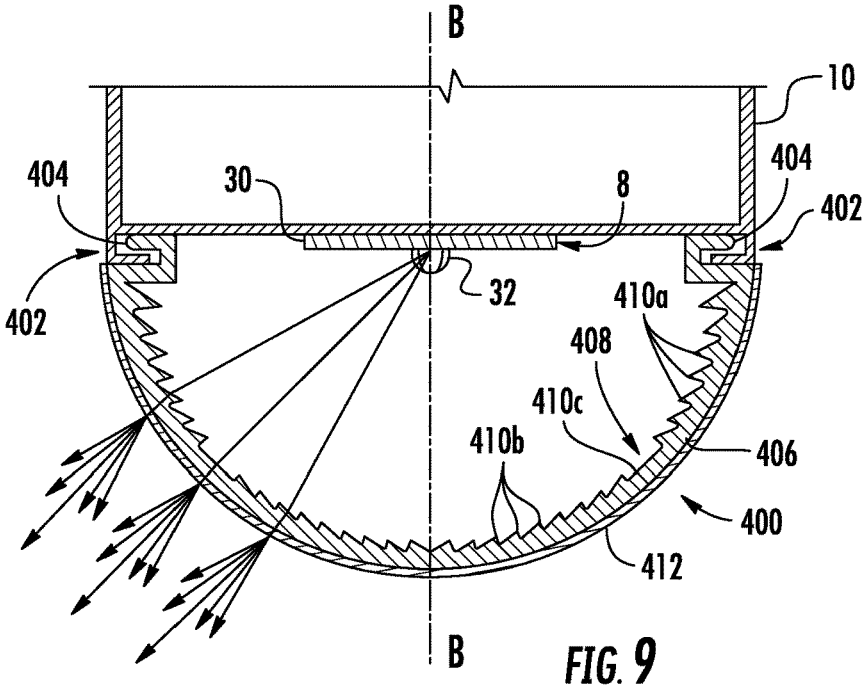

Referring to FIGS. 8 and 9 one embodiment of a lens 400 that may be used as lens 2 in the light fixture 1 is shown. Lens 400 has a curved or domed cross-section and in some embodiments may be semicircular in cross-section. In one embodiment the lens 400 may comprise a cylindrical lens where the lens is a segment of a hollow cylinder where the profile of the lens is generally formed on arc of a circular. The lens may also be considered a dome lens that in cross-section has a curved or dome-shaped profile that is not an arc of a circle. The lens 400 has two longitudinal edges 402 that extend for the length of the lens and include mounting features 404 for securing the lens 400 to the housing 6 or to the support structure 10. In the illustrated embodiment the mounting features 404 comprise grooves that are engaged by a mating longitudinally extending lip 15 that extends along the length of the housing 6 or the support structure 10. The lens 400 may be resiliently deformed to engage the mounting features 404 on the lens 400 with the mating mounting features 15 on the housing 6 or the support structure 10. The lens 400 may also be secured to the housing 6 or to the support structure 10 by other structures or mechanisms. In some embodiments the lens may be secured to the support structure 10, and the support structure 10, the lens and the LED assembly 8 may be mounted to the housing 6 as a unit while in other embodiments the support structure 10 and LED assembly 8 may be mounted to the housing 6 as a unit and the lens may be mounted to the housing 6. The mounting structure as described herein may be used with any of the embodiments of the lenses as described herein.

Figure 17:
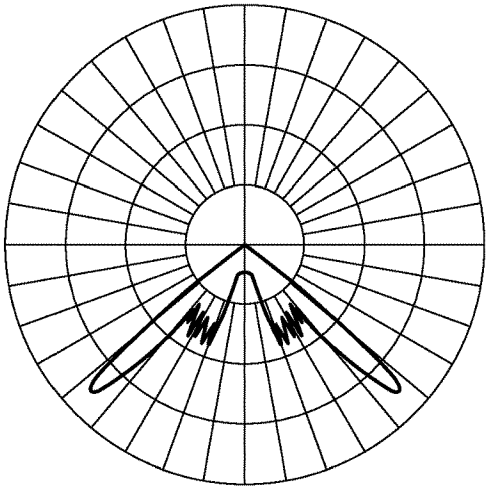
Figure 22:
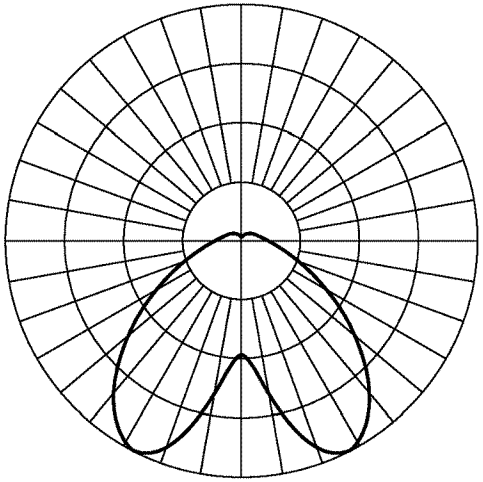
Figure 21:
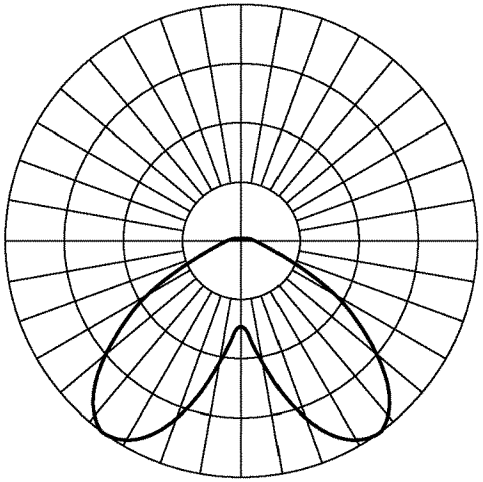

In the embodiment of FIG. 8 the lens 400 has a smooth outer or exit surface 406 and the inner or entry surface 408 is formed with light shaping features that in the illustrated embodiment comprise a Fresnel prism with a plurality of prismatic features 410 formed in the surface. The prismatic features 410 extend for at least a portion of the lens and in one embodiment the prismatic features 410 extend for the entire length of the lens 400 parallel to the longitudinal axis A-A of the lens. The prismatic features are configured to provide a symmetric batwing light emission pattern as shown in FIG. 17. The prismatic features 410 form a stepped or chirped pattern where at least some of the individual prismatic features 410 have different prism angles relative to the emitted light as other ones of the prismatic features 410. In some embodiments each of the individual prismatic features 410 has a different prism angle relative to the emitted light as the other ones of the prismatic features 410 while in some embodiments some of the individual prismatic features 410 has the same prism angle relative to the emitted light as other ones of the prismatic features 410. The angle of the entry surfaces of prismatic features 410 relative to the incoming light and the angle of a line tangent to the exit surface are controlled such that the emitted light from any portion of the lens may be directed in a desired direction. In one embodiment the angles of the entry and exit surfaces are selected such that the light is emitted from the lens in a batwing or V pattern. Generally light from one half of the lens to one side of plane B-B is directed along one leg of the V-shape and light from the other half of the lens to the opposite side of plane B-B is directed along the other leg of the V-shape. The plane B-B is a plane extending perpendicularly from the plane of the LEDs positioned generally along the centerline of the LED array. Because the lens 400 is intended to emit a light pattern that is symmetrical about plane B-B, the two halves of the lens are mirror images of one another. In the illustrated embodiment the prismatic features are divided generally into two groups 410*a* and 410*b* separated by an area 410*c* in which the entry and exit surfaces are disposed generally perpendicular to the light. The area 410*c* does not redirect the light rays such that light rays C that enter area 410*c* exit the lens unchanged in direction. The direction of light ray C may be considered to be the approximate center of the first peak of light. The light rays B entering prismatic features 410*b* are directed generally toward the center in a first direction and light rays A entering prismatic features 410*a* are directed generally toward the center in a second direction. The angles of prismatic features are selected to control the amount of redirection of the light rays and to control the width of the peak. Moreover, within each group of prismatic features the features may have different angles to control the direction of the emitted light. In some embodiments, area C may be eliminated such that the entire lens surface is provided with prismatic features. The same arrangement may be provided on both halves of the lens (to each side of center plane B-B) to create a symmetric V-shape or batwing distribution. The light emission pattern of the lens 400 without the diffusive layer 408 is shown in FIG. 17.

Figure 20:
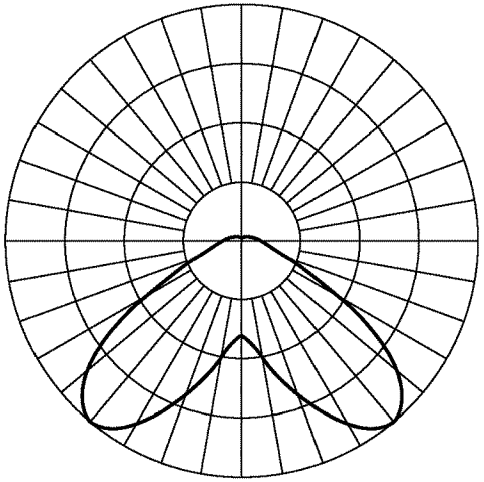

Referring to FIG. 9 the lens 400 of FIG. 8 is shown, however, the outer or exit surface 406 is provided with a diffusive layer 412. The diffusive layer 412 may be extruded with the lens. The diffusive layer 412 may also be formed by applying a diffusive coating or film to the exit surface 406. The diffusive layer 412 may also be formed by roughening or texturing the exit surface 406. The roughening or texturing of the exit surface 406 may be done after the lens is molded such as by sand blasting or the roughening or texturing of the exit surface 406 may be done as part of the manufacturing process of the lens, for example, the texturing may be formed as part of the molding process that forms the lens. The diffusive layer 412 may be formed in other manners as well. The prismatic features direct the light as previously described with respect to FIG. 8. However, the diffusive layer 412 diffuses the exiting light rays to create a scattering effect such that within the desired distribution the light is softened and diffused enabling the refracted outgoing rays to disperse with a wide angular distribution while maintaining the main light angle. The same arrangement may be provided on both halves of the lens to create a symmetric V-shape or batwing distribution. The light emission pattern of the lens 400 with the diffusive layer 408 is shown in FIG. 20.

Comparing the light emission pattern of the lens 400 without the diffusive layer (FIG. 17) against the light emission pattern of the lens 400 with the diffusive layer (FIG. 20) shows that in both embodiments a symmetric batwing or V-shaped light distribution pattern is generated where light is generated with two distinct peaks that are symmetrically disposed relative to the longitudinal center plane B-B of the light fixture. The lens without the diffuser shows sharper peaks (glaring) within the batwing distribution (FIG. 17) while the lens with the diffuser shows a smoother distribution while maintaining the desired overall light illumination pattern (FIG. 20). Thus, use of the diffusive layer 412 minimizes glaring and smoothes the emitted light. The diffusive layer is selected such that the diffusing angle of the layer is relatively small, on the order of 10-30 degrees in order to maintain the desired light emission distribution. If the diffusing angle is too large (e.g. >50 degrees) the directionality of the emitted light may be washed out and the directionality of the desired light distribution may be lost.

Figure 14:
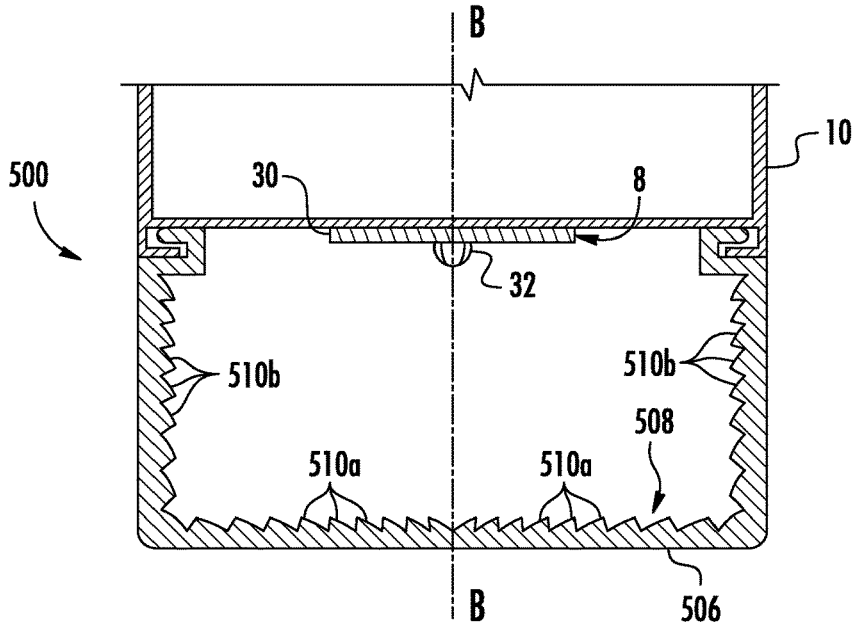
FIG. 14 is a section view of an alternate embodiment of a lens usable in the light fixture of FIG. 1.
Figure 15:
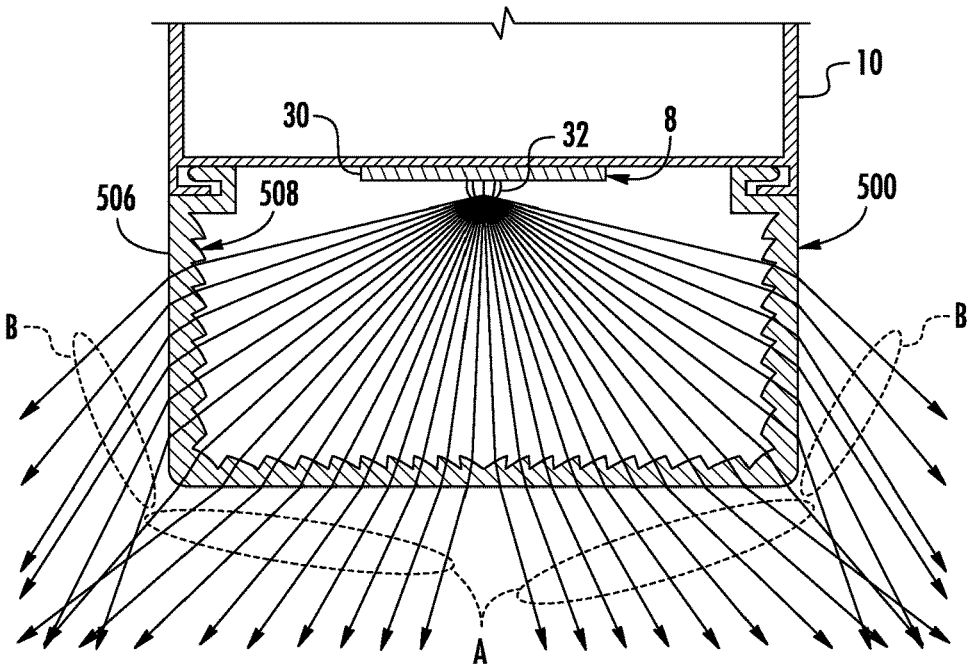
FIGS. 15 and 16 are section views of a light fixture with alternate embodiments of the lens of FIG. 14 showing light emission patterns.
Figure 16:
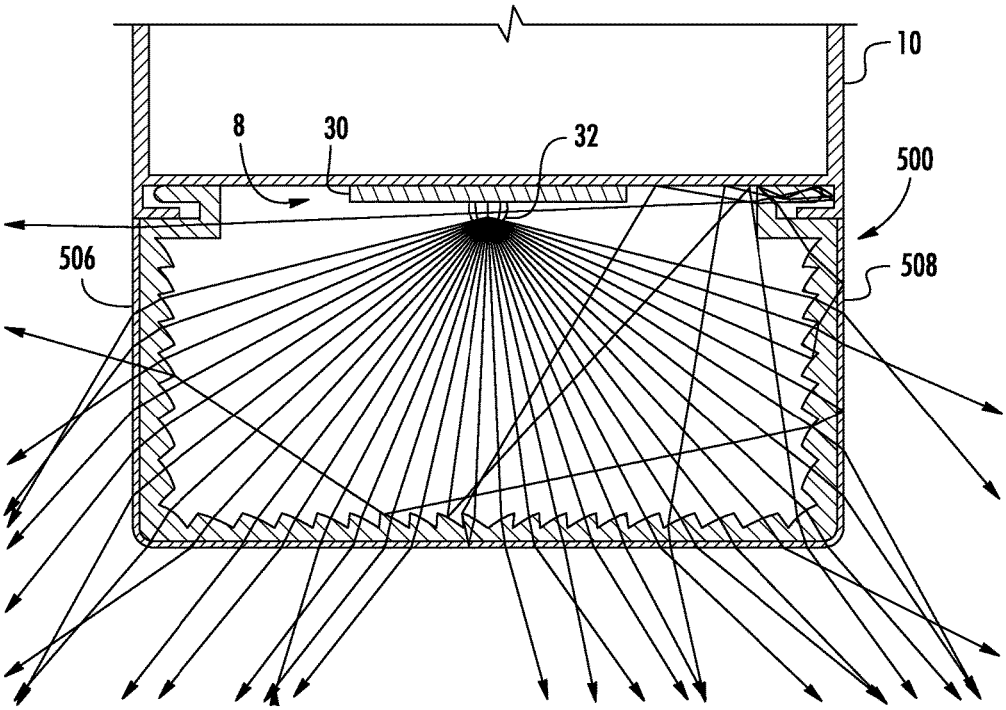
Figure 19:
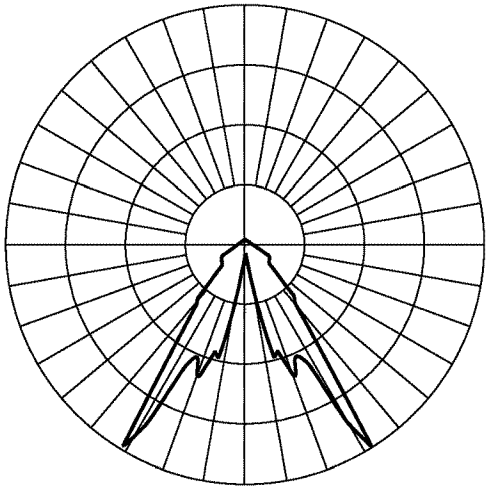
FIGS. 17-22 are intensity distribution diagrams of the lighting fixture useful in explaining the invention.
Figure 18:
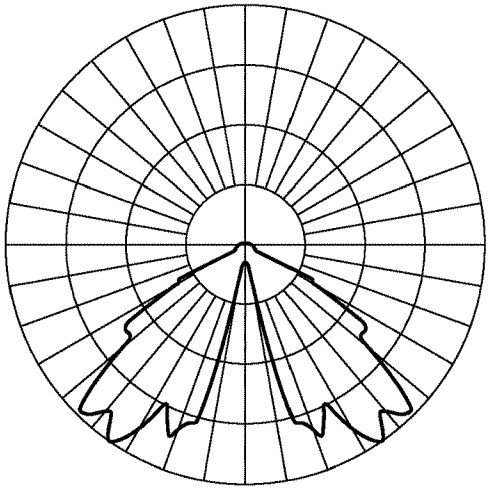

Referring to FIGS. 14 and 15 an acrylic lens 500 is shown having a smooth outer or exit surface 506 and the inner or entry surface 508 is formed with light shaping features that in the illustrated embodiment comprise a Fresnel prism with a plurality of prismatic features 510*a*, 510*b* formed in the surface. FIG. 16 shows lens 500 with a diffusive layer 508 over the outer or exit surface 506. The diffusive layer 508 may be formed as previously described. The lens 500 has a rectangular shape where the width of the lens is greater than the depth of the lens. In the illustrated embodiment the prismatic features are divided generally into two groups 510*a* and 510*b*. The light rays A entering prismatic features 510*a* are directed generally toward the center of the peak in a first direction and light rays B entering prismatic features 510*b* are directed generally toward the center of the peak in a second direction. The angles of prismatic features are selected to control the amount of redirection of the light rays and to control the width of the peak. Moreover, within each group of features the features may have different angles. The same arrangement may be provided on both sides of the lens to create a symmetric V-shape or batwing distribution. Comparing the light emission pattern of the lens 500 without the diffusive layer (FIG. 18) against the light emission pattern of the lens 500 with the diffusive layer (FIG. 21) shows that in both embodiments a symmetric batwing or V-shape light distribution pattern is generated where light is generated with two distinct peaks that are symmetrically disposed relative to the longitudinal axis of the light fixture. The lens without the diffuser (FIG. 18) shows sharper peaks within the batwing distribution while the lens with the diffuser (FIG. 21) shows smoother distributions while maintaining the desired overall light illumination pattern. Moreover, the batwing distribution of the curved lens is somewhat different than the batwing distribution of the rectangular lens as is shown in a comparison of FIGS. 17 and 20 with FIGS. 18 and 21. Thus, the overall shape of the lens as well as the shape and distribution of the prismatic features may be used to alter the light distribution of the light fixture.

Figure 23:
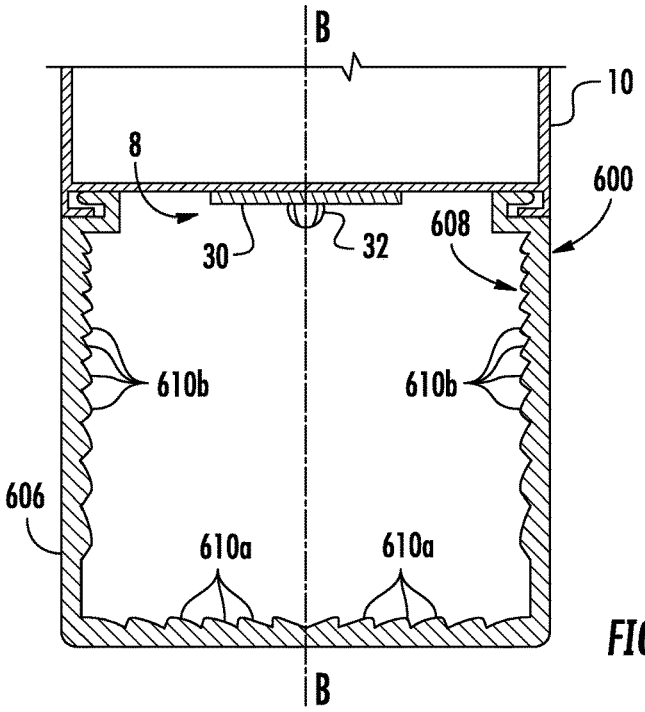
FIG. 23 is a section view of an alternate embodiment of a lens usable in the light fixture of FIG. 1.
Figure 24:
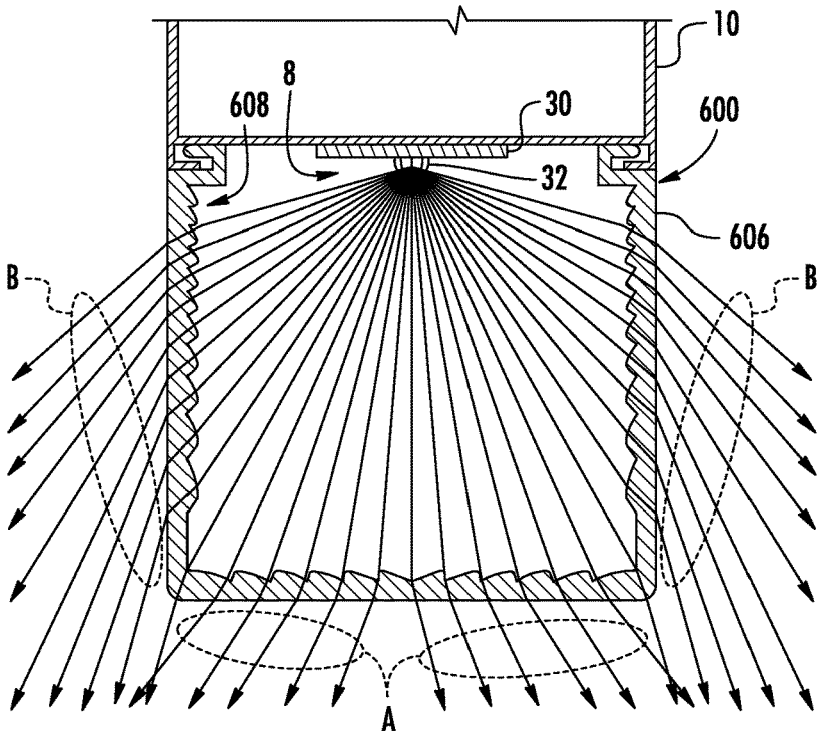
FIGS. 24 and 25 are section views of a light fixture with the lens of FIG. 23 showing a light emission pattern.
Figure 25:
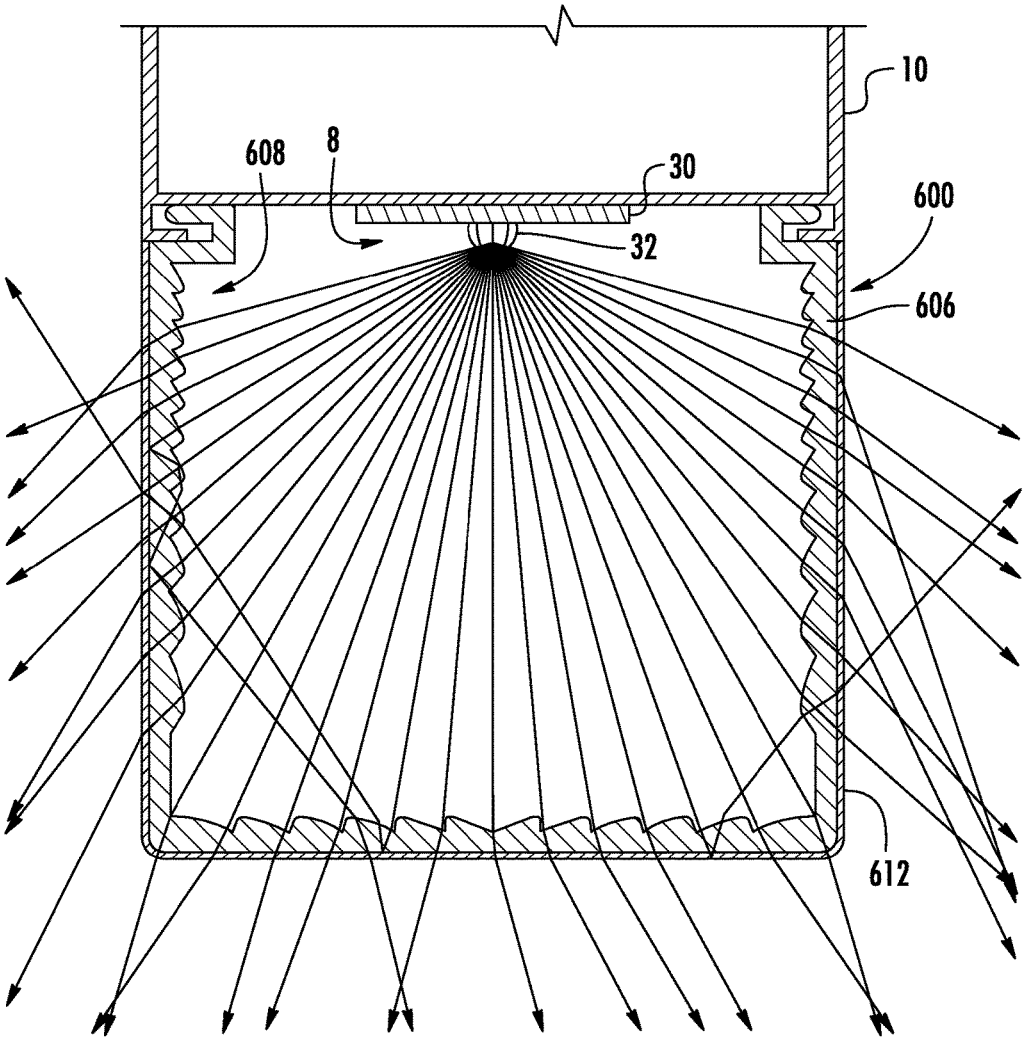

Referring to FIGS. 23 and 24 an acrylic lens 600 is shown having a smooth outer or exit surface 606 and the inner or entry surface 608 is formed with light shaping features that in the illustrated embodiment comprise a Fresnel prism with a plurality of prismatic features 610*a*, 610*b* formed in the entry surface 608. FIG. 25 shows lens 600 where a diffusive layer 612 is formed on the outer or exit surface 606. The diffusive layer 612 may be formed as previously described. The lens 600 has a square shape where the width of the lens is approximately equal to the depth of the lens. In the illustrated embodiment the prismatic features are divided generally into two groups 610*a* and 610*b*. The light rays A entering prismatic features 610*a* are directed generally toward the center of the peak in a first direction and light rays B entering prismatic features 610*b* are directed generally toward the center of the peak in a second direction. The angles of prismatic features are selected to control the amount of redirection of the light rays and to control the width of the peak. Moreover, within each group of features the individual features may have different angles. Each feature angle in the group can be a specific angle different from other feature angles, i.e., individual features or facets's angles may be different for the individual features. Such varied angles would give a more smooth distribution and facilitates controlling the beam (peak) angle. The same arrangement may be provided on both halves of the lens to create a symmetric V-shape or batwing distribution. Comparing the light emission pattern of the lens 600 without the diffusive layer (FIG. 19) against the light emission pattern of the lens 600 with the diffusive layer (FIG. 22) shows that in both embodiments a symmetric batwing light distribution pattern is generated where light is generated with two distinct peaks that are symmetrically disposed relative to the longitudinal axis of the light fixture. The lens without the diffuser (FIG. 19) shows sharper peaks within the batwing distribution while the lens with the diffuser (FIG. 22) shows smoother distributions while maintaining the desired overall light illumination pattern. Moreover, the batwing distribution of the square lens 600 is somewhat different than the batwing distribution of the rectangular lens and the circular lens as is shown in a comparison of FIGS. 17, 18 and 19 and Fi20, 21 and 22. Thus, the overall shape of the lens as well as the shape and distribution of the prismatic features may be used to alter the light distribution of the light fixture.

Figure 26:
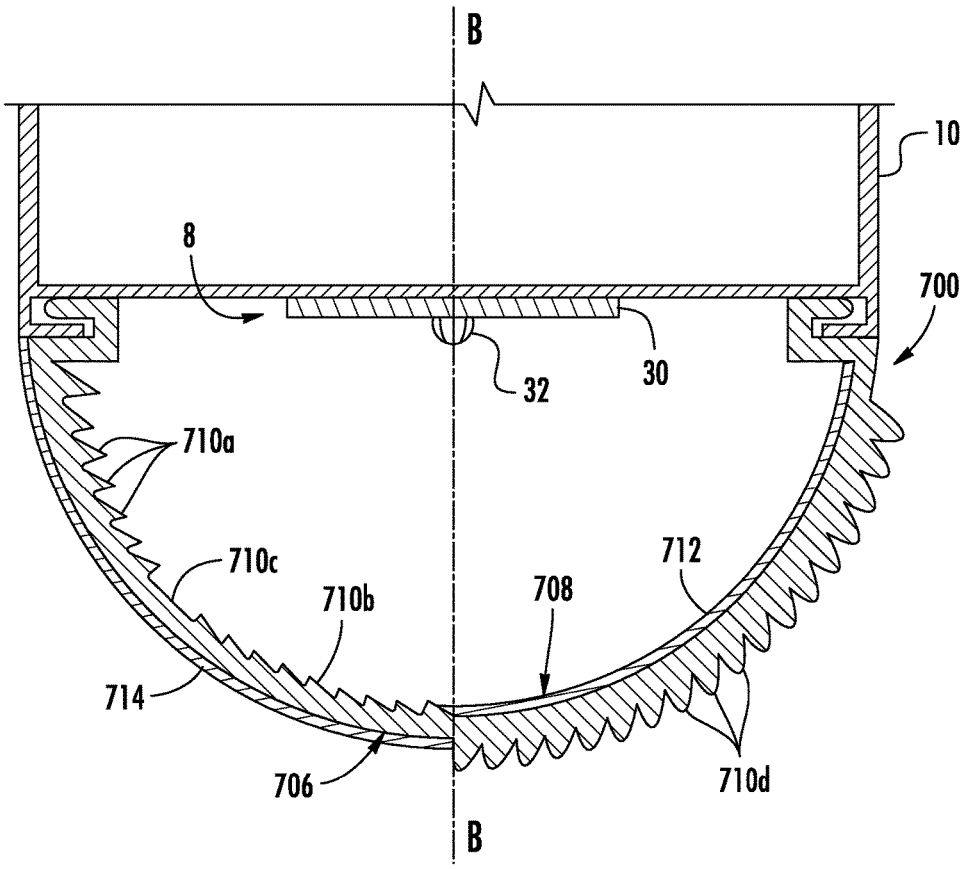
FIG. 26 is a section view of an alternate embodiment of a lens usable in the light fixture of FIG. 1.
Figure 27:
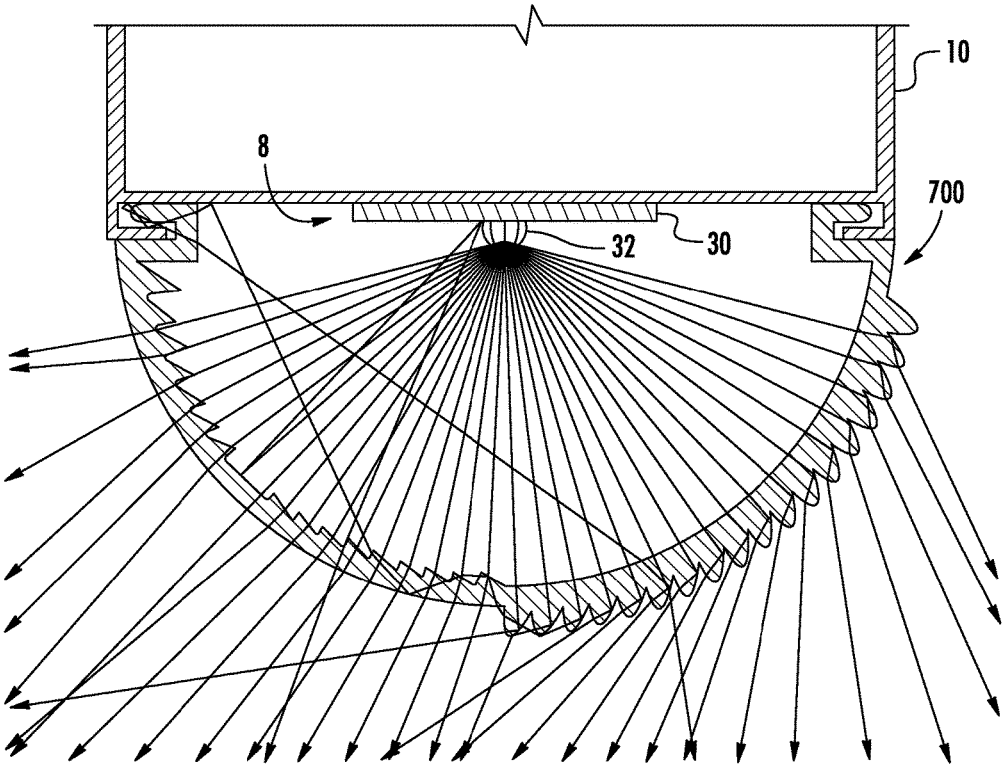
FIG. 27 is a section view of a light fixture with the lens of FIG. 26 showing a light emission pattern.
Figure 32:
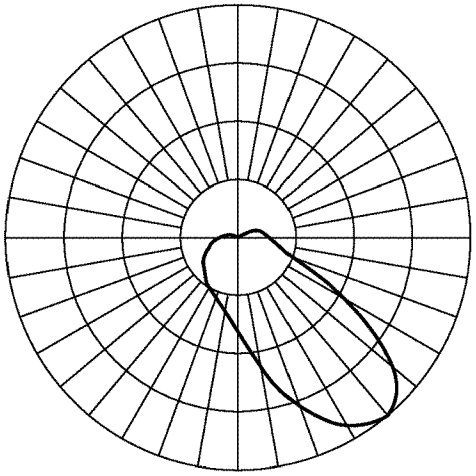

Referring to FIGS. 26 and 27, one embodiment of a lens for generating an asymmetric light emission pattern is shown. Lens 700 has a curved or domed cross-section and in some embodiments may be semicircular in cross-section. In one embodiment the lens is made of a transparent material such as clear acrylic. In the embodiment of FIGS. 26 and 27 the lens 700 has an outer or exit surface 706 and an inner or entry surface 708. One half of the entry surface 708 is formed with light shaping features that in the illustrated embodiment comprise a Fresnel prism with a plurality of prismatic features 710*a* and 710*b* separated by a non-refracting area 710*c*. One half of the exit surface 706 is formed as a Fresnel prism with a plurality of prismatic features 710*d* formed in the surface. Specifically, the prismatic features 710*d* are formed to one side of the center plane B-B and the prismatic features 710*a*, 710*b* and 710*c* are formed on the opposite side of the plane B-B. The prismatic features extend for the length of the lens and are configured to provide an asymmetric light emission pattern as shown in FIG. 32. The prismatic features 710*a*, 710*b* and 710*c* operate as previously described to direct the light to create a directional light emission pattern such as a single wing or leg. The prismatic features 710*d* operate using the principal of total internal reflection (TIR) to redirect at least a portion of the light that impinges on these features back toward the prismatic features 710*a*, 710*b* and 710*c*. TIR occurs when a propagated wave strikes a medium boundary at an angle larger than a particular critical angle with respect to the normal to the surface. If the refractive index is lower on the other side of the boundary and the incident angle is greater than the critical angle, the light wave cannot pass through and is entirely reflected. The reflected light is redirected and emitted from the lens via prismatic features 710*a*, 710*b* and 710*c* in the desired distribution pattern.

In some embodiments a first diffusive layer 712 may formed on the entry surface opposite the prismatic features 710*d* and a second diffusive layer 714 may be formed on the exit surface opposite the prismatic features 710*a*, 710*b* and 710*c*. The diffusive layers 712 and 714 may be formed as previously described. In some embodiments the diffusive layers may be omitted such that the light emission pattern has sharper peaks as previously described with respect to the batwing distributions. Referring to FIG. 32 the light distribution pattern for a lens configured as shown in FIGS. 26 and 27 is illustrated which has an asymmetric light distribution pattern relative to the longitudinal center plane B-B axis of the lens. By providing the diffusive layer 712 on the entry surface opposite prismatic features 710*d*, the light is diffused and scattered upon entry into lens 700. By scattering of the light using a diffusive layer 712 on the entry surface of the lens some of the light rays are refracted by the prismatic features and other of the light rays are reflected by TIR toward the asymmetric distribution (to the left as viewed in FIG. 26) to thereby increase the light directed toward the peak emission distribution.

Figure 28:
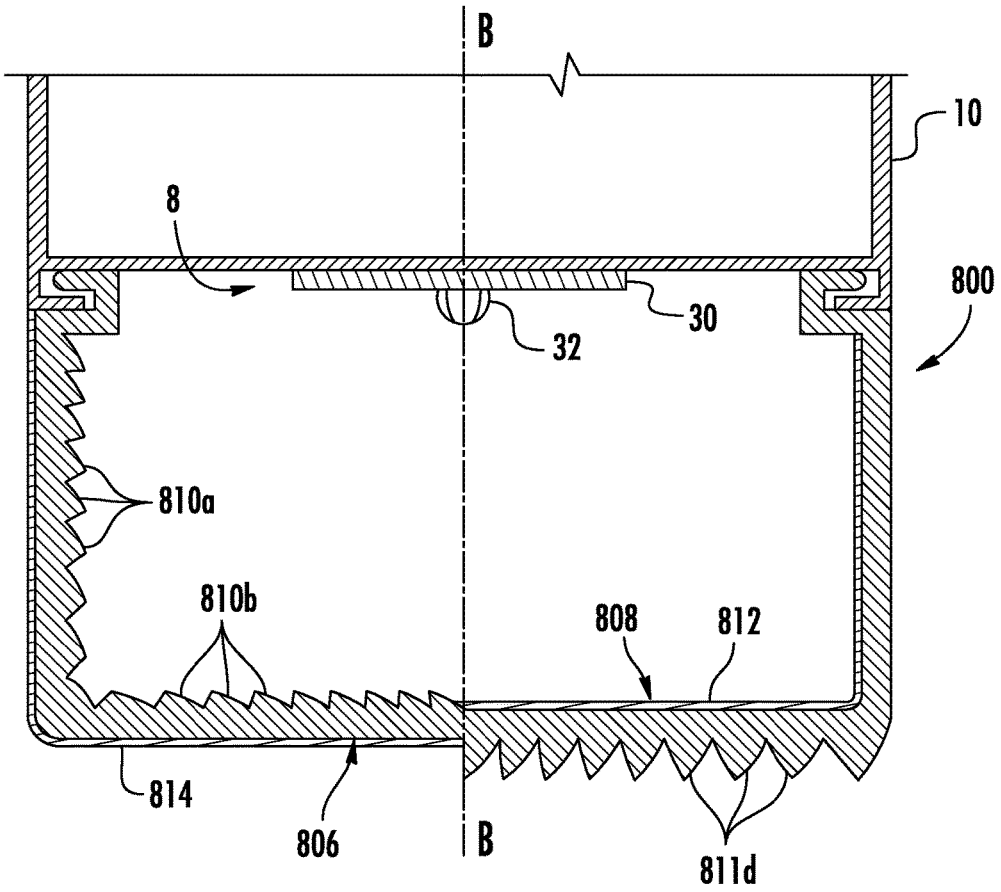
FIG. 28 is a section view of an alternate embodiment of a lens usable in the light fixture of FIG. 1.
Figure 29:
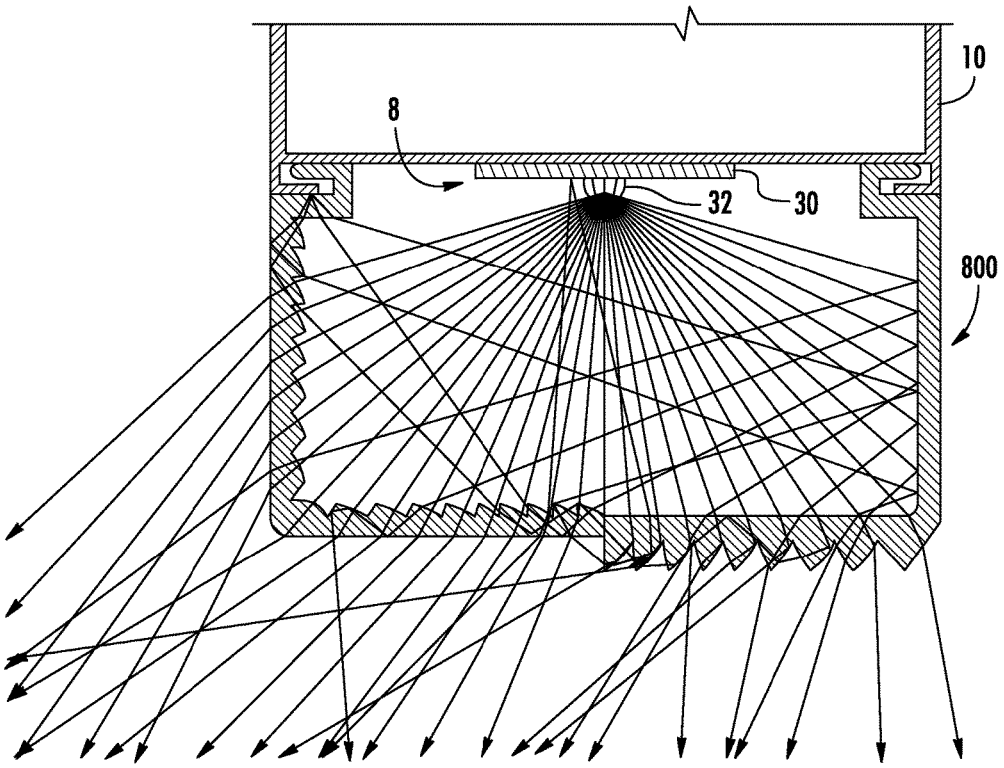
FIG. 29 is a section view of a light fixture with the lens of FIG. 28 showing a light emission pattern.
Figure 30:
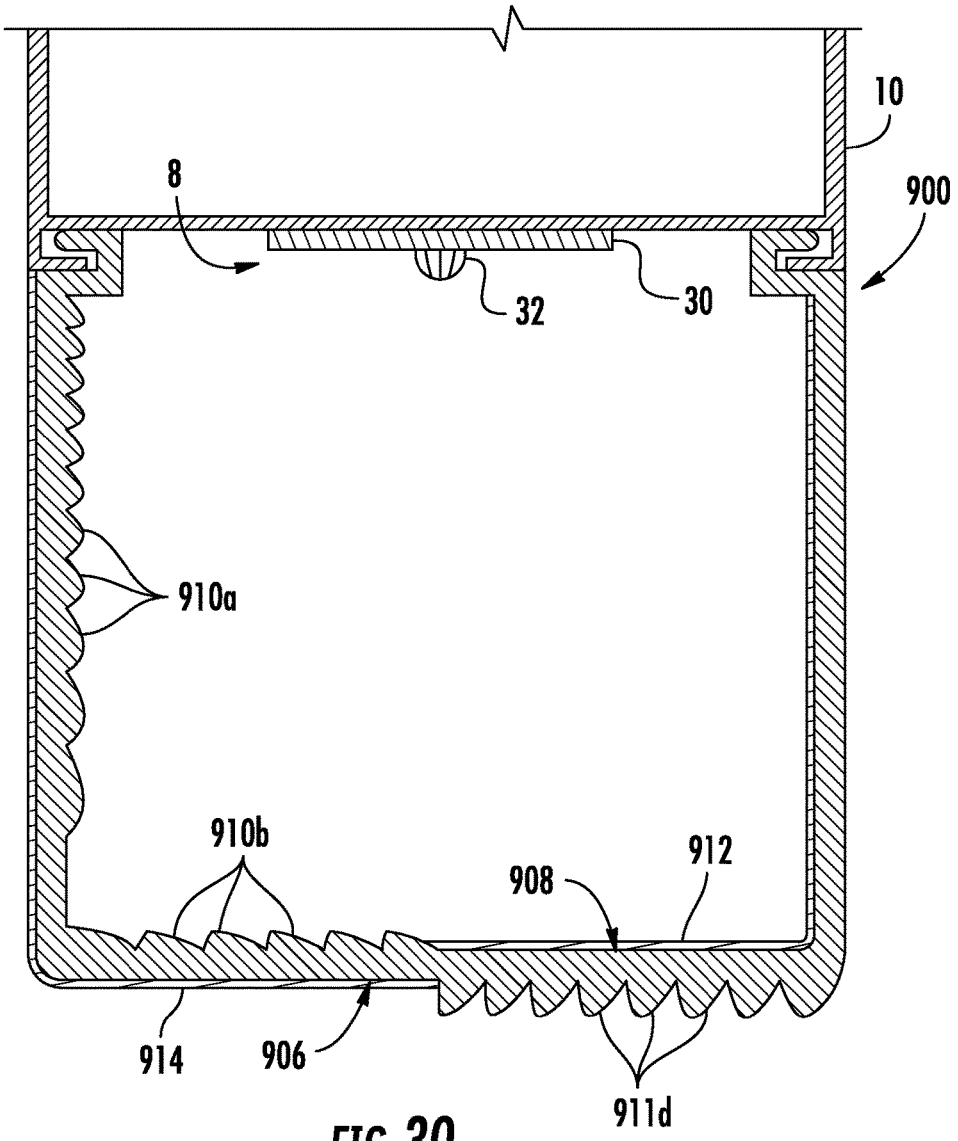
FIG. 30 is a section view of an alternate embodiment of a lens usable in the light fixture of FIG. 1.
Figure 31:
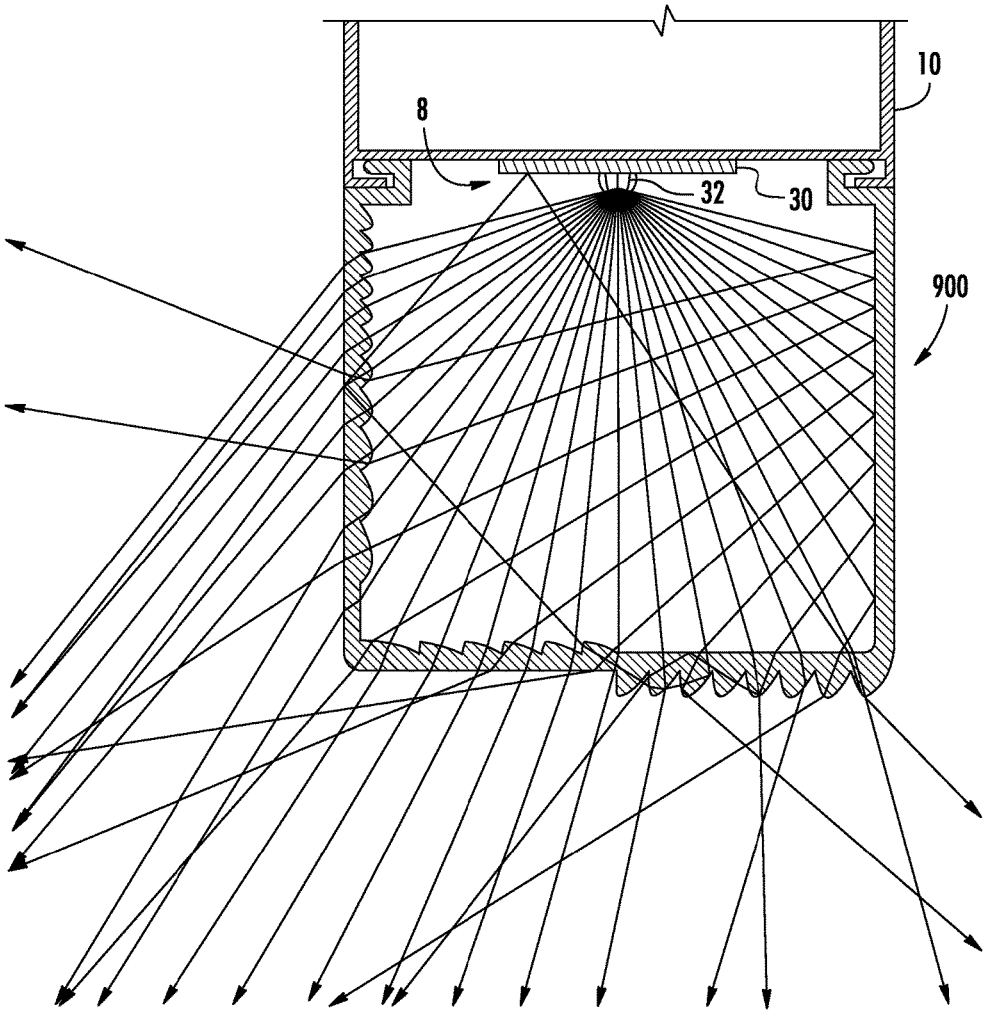
FIG. 31 is a section view of a light fixture with the lens of FIG. 30 showing a light emission pattern.

The asymmetric light distribution patterns may be provided with lenses that have a shape other than circular. For example FIGS. 28 and 29 show a lens 800 having a rectangular shape where the width of the lens is greater than the depth of the lens and FIGS. 30 and 31 show a lens 900 having a square shape where the width of the lens is approximately equal to the depth of the lens. One half of the entry surfaces 808, 908 of lenses 800, 900 is formed with light shaping features that in the illustrated embodiment comprise a Fresnel prism with a plurality of prismatic features 810*a* and 810*b* and 910*a* and 910*bc*, respectively, formed in the surface and at least a portion of the other half of the exit surface 806, 906 is formed as a Fresnel prism with a plurality of prismatic features 811*d*, 911*d*, respectively, formed in the surface. Specifically, the prismatic features 810*a* and 810*b*, and 910*a* and 910*b* are formed to one side of the center plane B-B and the prismatic features 811*d*, 911*d* are formed on the opposite side of the plane B-B. The prismatic features extend for the length of the lens and are configured to provide an asymmetric light emission pattern. A first diffusive layer 812 may be formed on the entry surface opposite the prismatic features 811*d* and a second diffusive layer 814 may be formed on the exit surface opposite the prismatic features 810*a*, 810*b*. Likewise, a first diffusive layer 912 is formed on the entry surface opposite the prismatic features 911*d* and a second diffusive layer 914 is formed on the exit surface opposite the prismatic features 910*a*, 910*b*. The diffusive layers may be formed as previously described. The prismatic features 810*a*, 810*b* and 910*a*, 910*b* operate as previously described to direct the light to create a directional light emission pattern such as a single wing or leg. The prismatic features 811*d* and 911*d* operate using the principal of total internal reflection (TIR) to redirect at least a portion of the light that impinges on these features back toward the prismatic features 810*a*, 810*b* and 910*a*, 910*b*. The reflected light is redirected and emitted from the lens via prismatic features 810*a*, 810*b* and 910*a*, 910*b* in the desired distribution pattern. In some embodiments the diffusive layers may be omitted such that the light emission pattern has sharper peaks as previously described with respect to the batwing distributions.

Figure 34:
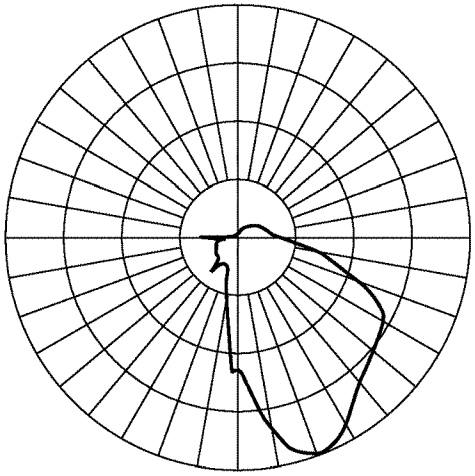
FIGS. 32-34 are intensity distribution diagrams of the lighting fixture useful in explaining the invention.
Figure 33:
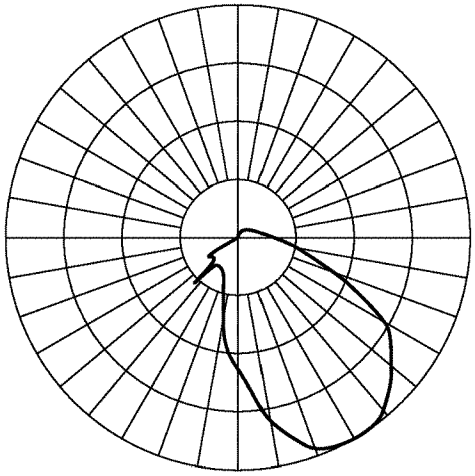

FIG. 33 shows the light distribution pattern for a lens configured as shown in FIGS. 28 and 29 which has an asymmetric light distribution pattern relative to the center plane of the lens. FIG. 34 shows the light distribution pattern for a lens configured as shown in FIGS. 30 and 31 which has an asymmetric light distribution pattern relative to the center plane of the lens.

Figure 35:
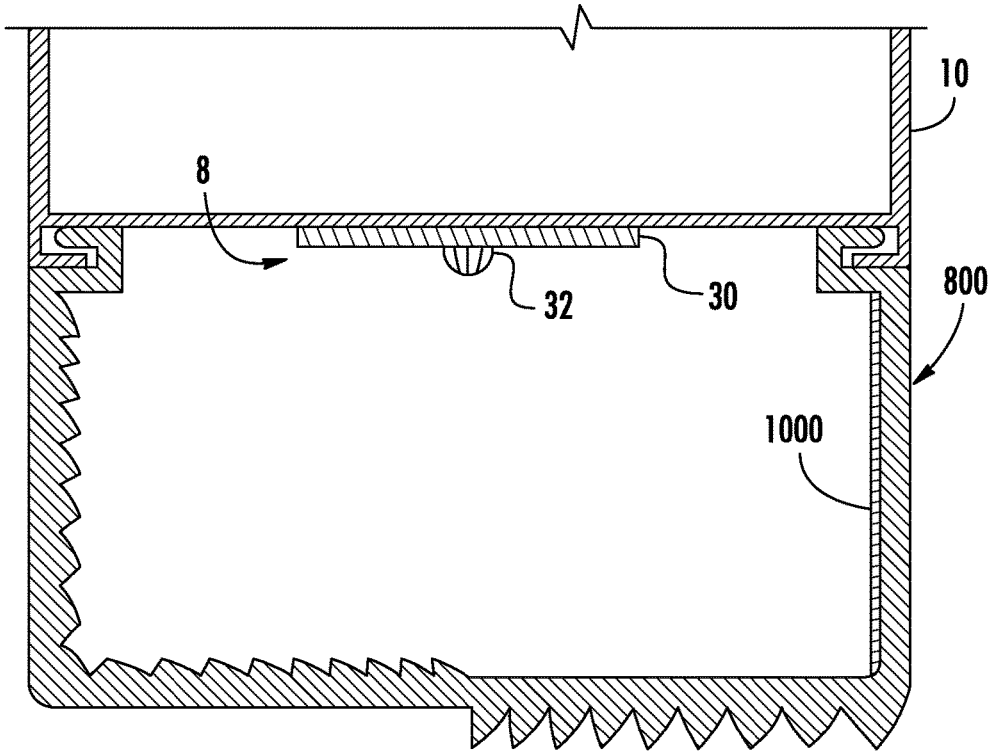
FIGS. 35 and 36 are section views of an alternate embodiments of a lens usable in the light fixture of FIG. 1.
Figure 36:
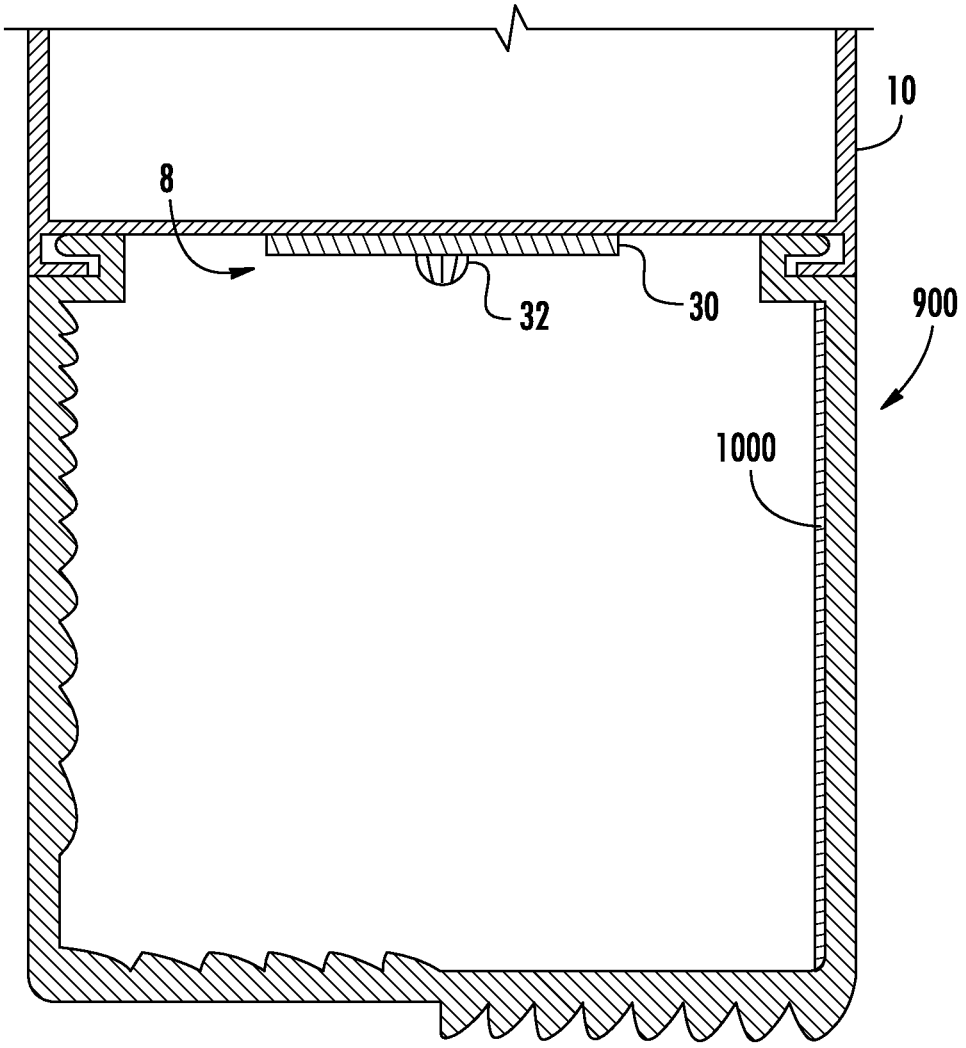
Figure 39:
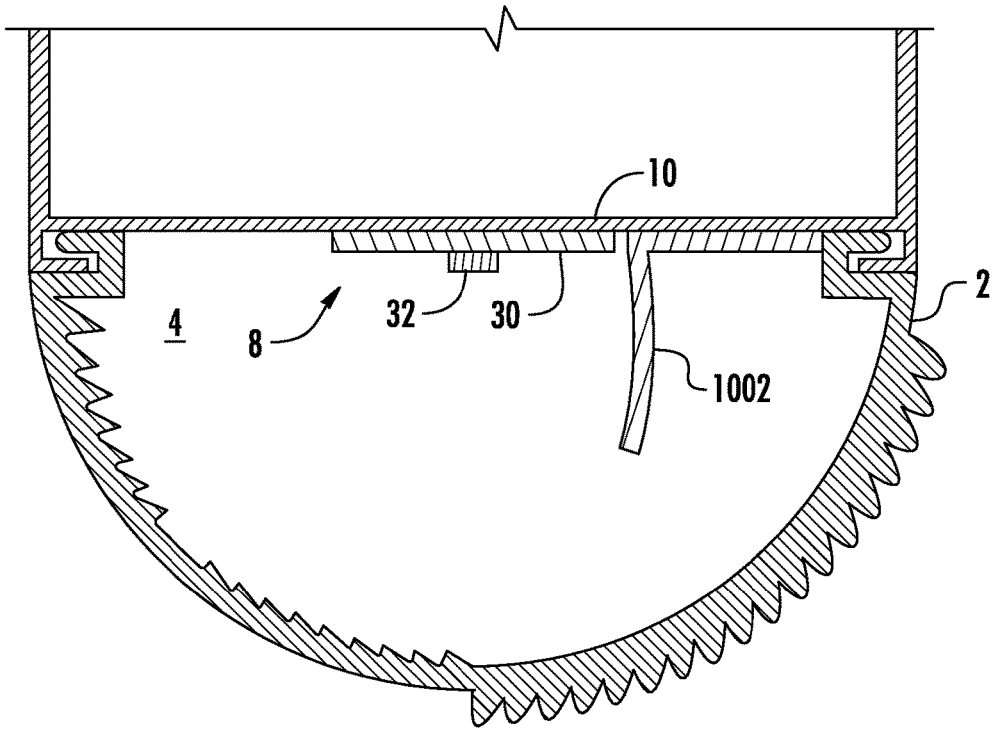
FIG. 39 is a section view of an alternate embodiments of a lens usable in the light fixture of FIG. 1.

For some lenses the TIR elements may not reflect sufficient light to the light shaping features. In some embodiments it may be necessary to use a reflector 1000 on the inside surface of the lens to reflect at least a portion of the light to the light shaping features as shown in FIGS. 35 and 36. The reflector may cover all or a portion of the lens opposite to the light shaping features. In the illustrated embodiments the reflector 1000 is positioned along one lateral side of the lens however the reflector may cover more or less of the lens and may positioned at any position where TIR reflection does not reflect sufficient light to the light shaping features. In one preferred embodiment, the reflector may comprise a specular planar reflector positioned to reflect at least a portion of the light toward the light shaping features. In other embodiments the reflector may comprise a diffusive reflector such as white optic provided a sufficient amount of light is reflected back to the Fresnel features. Referring to FIG. 39 the reflector 1002 may be disposed such that it extends into the interior space 4 and is not located on an inside surface of the lens 2. The reflector may be a separate component secured to the LED board 30, LED mounting structure 10, or lens 2, or it may be formed as part of lens 2. The various reflectors described herein may be coextruded with the lens.

Figure 40:
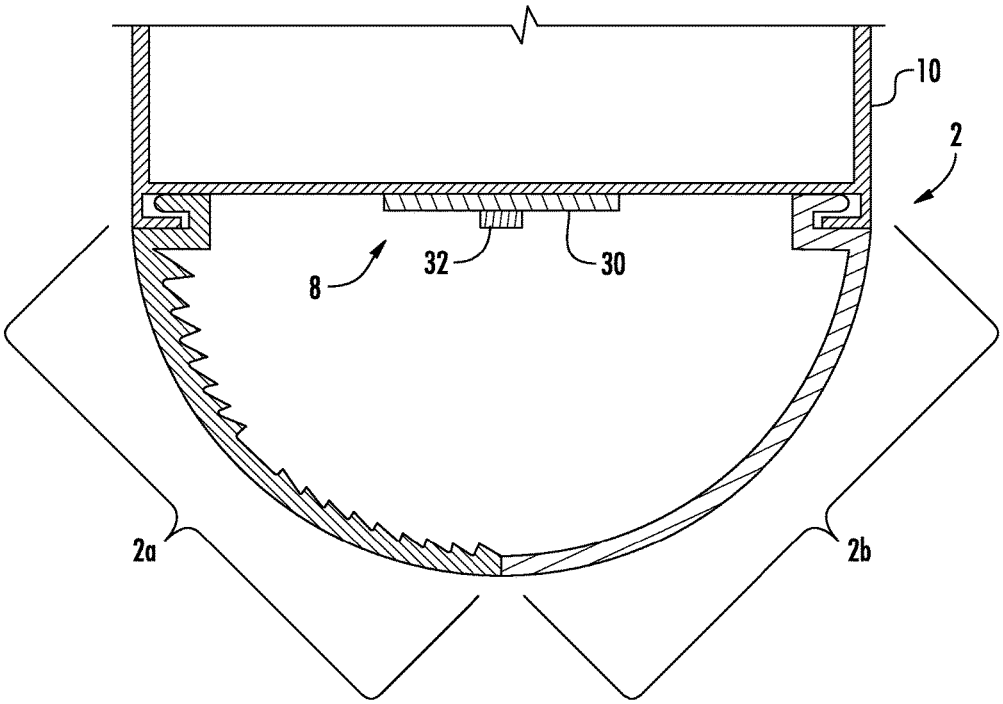
FIGS. 40 and 41 are section views of an alternate embodiments of a lens usable in the light fixture of FIG. 1.
Figure 41:
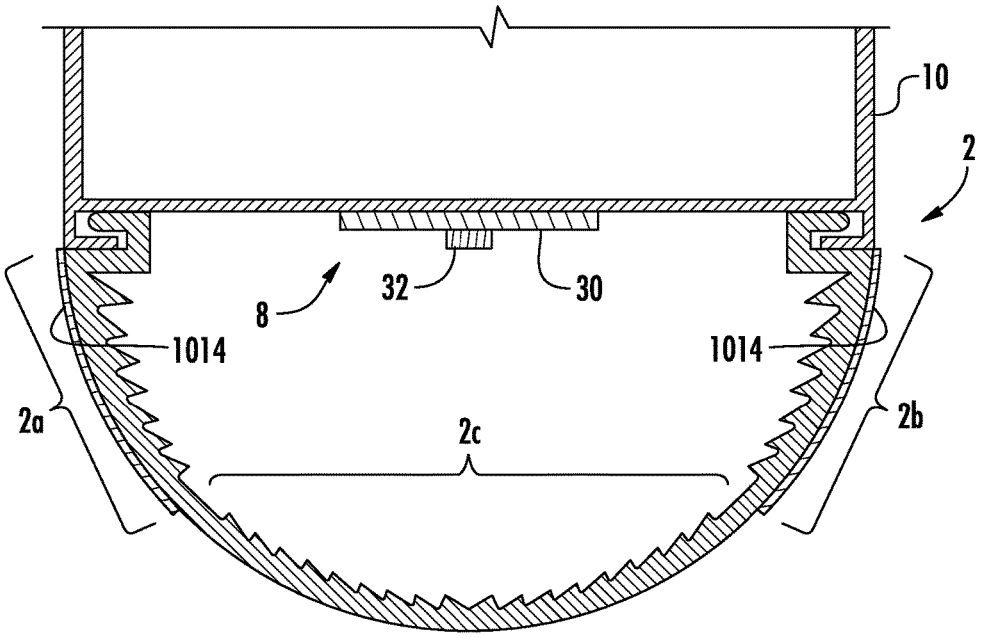

In any of the embodiments described herein the lens may include sections that are clear, translucent, reflective and/or opaque. The various different sections of the lens may be made of different materials which may be coextruded to form the lens. In other embodiments the various sections may be separate components secured together to form the lens. One embodiment of such a lens is shown in FIG. 40 where lens 2 is divided into sections 2*a* and 2*b*. Section 2*a* may be made as previously described with light shaping features and may comprise a diffusive layer. Section 2*b* may be made of an opaque material such as white plastic of a reflective material. In such an embodiment the lens may emit all of the light through section 2*a*. Another embodiment of such a lens is shown in FIG. 41 where lens 2 is divided into sections 2*a*, 2*b* and 2*c*. Section 2*a* may be made as previously described with Fresnel features and may comprise a diffusive layer. Sections 2*b* and 2*c* may be made with a diffusive layer 1014 and section 2*c* may be clear. The lenses as described herein may be made of multiple sections of materials with different optic properties to further modify the light emission pattern.

Figure 37:
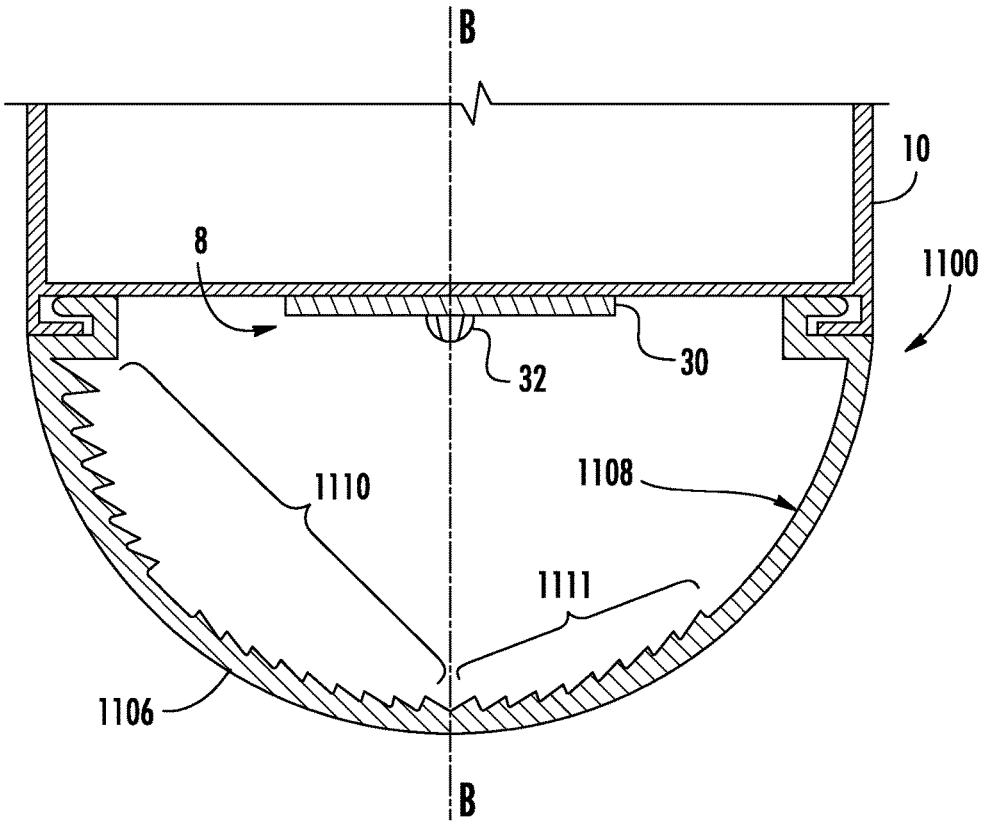
FIGS. 37 and 38 are section views of an alternate embodiments of a lens usable in the light fixture of FIG. 1.

In some embodiments, the light distribution pattern may be made more or less asymmetric. For example, the lens may be divided into zones that direct the light to various sides of the light fixture in various amounts. For example in the embodiment of FIG. 37 the lens 1100 may comprise an outer or exit surface 1106 and an inner or entry surface 1108. A first portion of the entry surface is formed with light shaping features that in the illustrated embodiment comprise Fresnel prism with a plurality of prismatic grooves 1110 formed in the surface and a second portion of the exit surface is formed as a Fresnel prism with a plurality of prismatic grooves 1111 formed in the surface. Unlike the previous embodiments the two portions are not symmetrically formed relative to the plane B-B. Diffusive layers may be formed on the exit surface 1106 as previously described. In some embodiments the diffusive layer may be omitted such that the light emission pattern has sharper peaks as previously described with respect to the batwing distributions.

Figure 38:
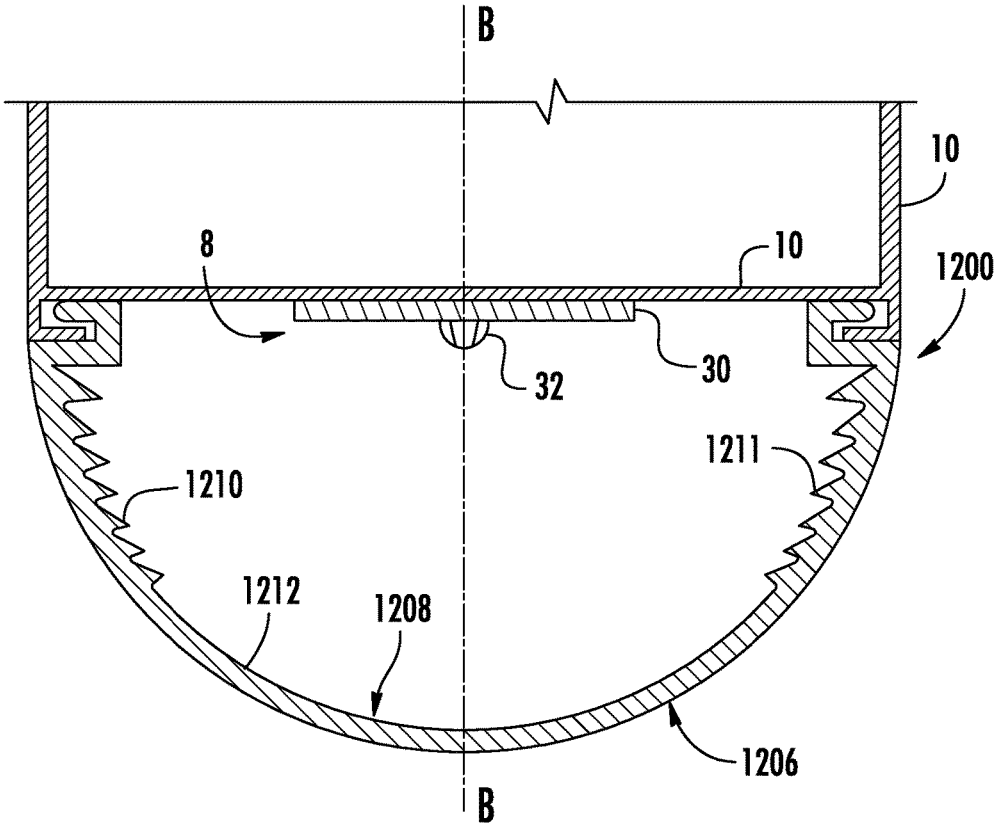

In some embodiments, the lens may be divided into zones that direct the light to various sides of the light fixture in various amounts. For example in the embodiment of FIG. 38 the lens 1200 may comprise an outer or exit surface 1206 and an inner or entry surface 1208. A first portion of the entry surface is formed with light shaping features that in the illustrated embodiment comprise a Fresnel prism with a plurality of prismatic grooves 1210 formed in the surface and a second portion of the exit surface is formed with light shaping features that in the illustrated embodiment comprise a Fresnel prism with a plurality of prismatic grooves 1211 formed in the surface where the two portions are symmetrically formed relative to the plane B-B. Unlike the previous embodiments, a center portion of the lens 1212 may be formed without any Fresnel optic component. Diffusive layers may be formed on the exit surface 1106 as previously described. In some embodiments the diffusive layer may be omitted such that the light emission pattern has sharper peaks as previously described with respect to the batwing distributions.

Figure 48:
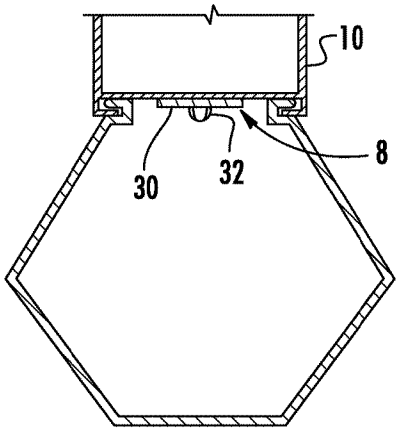
FIGS. 46-51 are section views similar to FIG. 5 showing alternate embodiments of the lens.
Figure 47:
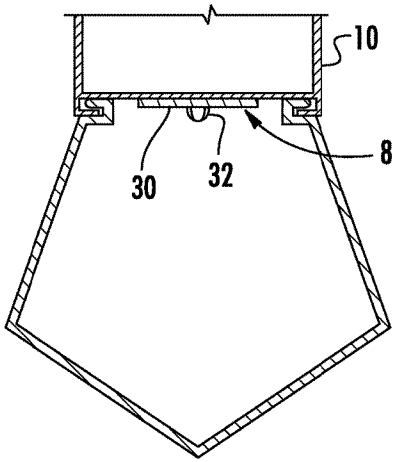
Figure 46:
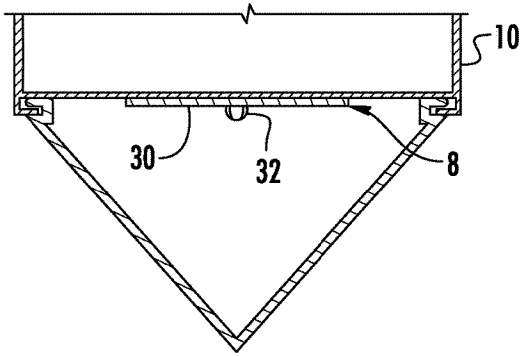
Figure 51:
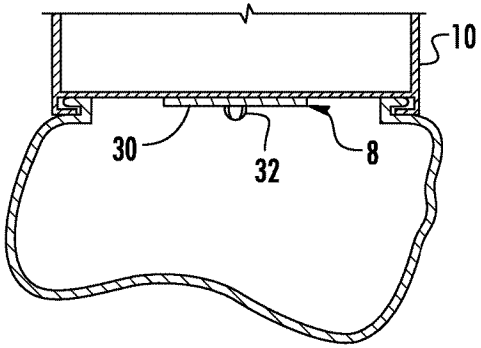
Figure 50:
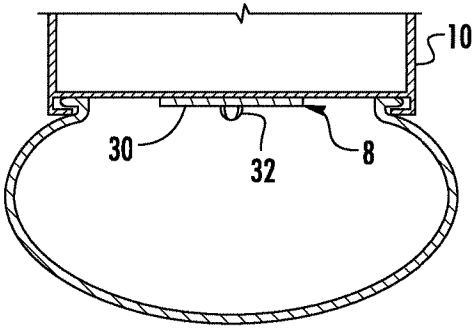
Figure 49:
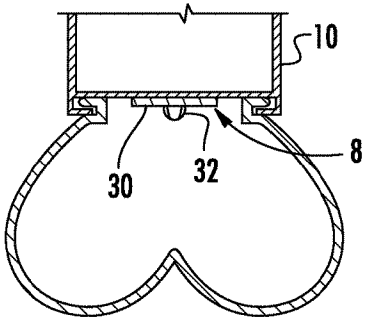

While specific shapes of the lens have been described in detail, the lens may have other shapes such as a triangular lens 1500 (FIG. 46); a pentagonal lens 1600 (FIG. 47); a hexagonal lens 1700 (FIG. 48); a heart shaped lens 1800 (FIG. 49); an oval lens 1900 (FIG. 50) or a freeform lens 2000 (FIG. 51). In any of the embodiments described herein the lens may include the arrangements of prismatic features as described herein and may include sections that are clear, translucent, reflective and/or opaque. The various different sections of the lens may be made of different materials which may be coextruded to form the lens. Diffusive and reflective layers may be used as shown and described with any of the embodiments of a lens and the lenses may exhibit varying degrees of symmetry or asymmetry as previously described.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A light fixture, comprising:

a LED assembly comprising a linear LED array emitting light when energized through an electrical path;

a lens having an first surface and a second surface, the lens covering the LED array for receiving the emitted light at the first surface and emitting light from the second surface, the lens comprising a plurality of light shaping features on at least one of the first surface and the second surface, the plurality of light shaping features configured to generate a directional light distribution pattern wherein the light pattern is asymmetric relative to a longitudinal axis of the light fixture.

2. The light fixture of claim 1 wherein the light pattern is symmetric about a longitudinal axis of the light fixture.

3. The light fixture of claim 1 wherein the lens is made of clear acrylic.

4. The light fixture of claim 1 wherein the first surface is formed with a plurality of prismatic features.

5. The light fixture of claim 1 wherein the second surface is smooth.

6. The light fixture of claim 1 wherein the second surface is provided with a diffusive layer.

7. The light fixture of claim 1 wherein the lens is may be one of semi-circular or rectangular in cross-section.

8. The light fixture of claim 1 wherein one half of the first surface is formed as a Fresnel prism comprising a plurality of first prismatic features and one half of the second surface is formed as a Fresnel prism comprising a plurality of second prismatic features.

9. The light fixture of claim 8 further comprising a first diffusive layer on the first surface opposite the first prismatic features and a second diffusive layer is formed on the second surface opposite the second prismatic features.

10. The light fixture of claim 1 wherein a first portion of the first surface is formed as a Fresnel prism comprising a plurality of first prismatic features and a second portion of the first surface is smooth and a first portion of the second surface is formed as a Fresnel prism comprising a plurality of second prismatic features and a second portion of the second surface is smooth.

11. The light fixture of claim 10 further comprising a first diffusive layer on the second portion of the first surface and a second diffusive layer on the second portion of the second surface.

12. The light fixture of claim 1 wherein the light shaping features are formed on the entire surface of one of the first surface and the second surface.

13. The light fixture of claim 1 wherein one half of the first surface is formed as a Fresnel prism comprising a plurality of first prismatic features and one half of the second surface is formed as a Fresnel prism comprising a plurality of second prismatic features wherein the one half of the first surface is offset with respect to the one half of the second surface.

14. A light fixture, comprising:

a housing;

a LED assembly comprising a linear LED array supported by the housing, the LED array emitting light when energized through an electrical path;

a lens having an entry surface and an exit surface, the lens covering the LED array for receiving the emitted light at the entry surface and emitting light from the exit surface, the lens comprising a plurality of prismatic elements on at least one of the entry surface and the exit surface, the plurality of prismatic elements configured to generate a directional light distribution pattern and a diffusive layer is on at least one of the entry surface and the exit surface.

15. The light fixture of claim 14 wherein the light pattern is symmetric about a plane extending perpendicularly to the LED array.

16. The light fixture of claim 14 wherein the light pattern is asymmetric relative to a plane extending perpendicularly to the LED array.

17. The light fixture of claim 14 wherein the lens comprises a plurality of sections, the plurality of sections made of different materials having different optical properties.

18. The light fixture of claim 14 wherein the entry surface is formed as a Fresnel prism.

19. The light fixture of claim 14 wherein the lens comprises a plurality of sections, the plurality of sections made of at least two different materials comprising at least two of a clear material, a diffusive material and an opaque material.

20. The light fixture of claim 14 wherein a reflector located inside of the lens.

21. The light fixture of claim 20 wherein the reflector is attached to the lens.

22. A light fixture, comprising:

a LED assembly comprising a linear LED array emitting light when energized through an electrical path;

a lens having an first surface and a second surface, the lens covering the LED array for receiving the emitted light at the first surface and emitting light from the second surface, the lens comprising a plurality of light shaping features on at least one of the first surface and the second surface, the plurality of light shaping features configured to generate a directional light distribution pattern wherein at least one half of the first surface is formed as a Fresnel prism comprising a plurality of first prismatic features and at least one half of the second surface is formed as a Fresnel prism comprising a plurality of second prismatic features wherein the at least one half of the first surface is offset with respect to the at least one half of the second surface.

23. A light fixture, comprising:

a housing;

a LED assembly comprising a linear LED array supported by the housing, the LED array emitting light when energized through an electrical path;

a lens having an entry surface and an exit surface, the lens having one of a square and a rectangular cross-section, the lens covering the LED array for receiving the emitted light at the entry surface and emitting light from the exit surface; and a reflector located inside of the lens and extending along the linear LED array positioned to reflect at least a portion of the light to produce an asymmetric light pattern.

24. The light fixture of claim 23 wherein the lens comprises a plurality of prismatic elements on at least one of the entry surface and the exit surface, the plurality of prismatic elements configured to generate a directional light distribution pattern where the reflector reflects the portion of the light toward the plurality of prismatic elements.

25. The light fixture of claim 23 further comprising a diffusive layer on at least one of the entry surface and the exit surface.

* * * * *